US009814278B2

(12) United States Patent
Chung et al.

(10) Patent No.: US 9,814,278 B2
(45) Date of Patent: Nov. 14, 2017

(54) PROTECTIVE HEADGEAR INCLUDING A PERSONNEL ELECTRONIC MONITOR DEVICE

(71) Applicant: AVANTE INTERNATIONAL TECHNOLOGY, INC., Princeton Junction, NJ (US)

(72) Inventors: Kevin Kwong-Tai Chung, Princeton, NJ (US); Albert Han-Ping Chung, New York, NY (US); Yulin Huang, East Windsor, NJ (US)

(73) Assignee: Avante International Technology, Inc., Princeton Junction, NJ (US)

( * ) Notice: Subject to any disclaimer, the term of this patent is extended or adjusted under 35 U.S.C. 154(b) by 28 days.

(21) Appl. No.: 14/884,375

(22) Filed: Oct. 15, 2015

(65) Prior Publication Data

US 2016/0106174 A1 Apr. 21, 2016

Related U.S. Application Data

(60) Provisional application No. 62/122,345, filed on Oct. 17, 2014.

(51) Int. Cl.
*G08B 1/08* (2006.01)
*A42B 3/04* (2006.01)
(Continued)

(52) U.S. Cl.
CPC ..... *A42B 3/0453* (2013.01); *A42B 3/046* (2013.01); *A42B 3/0433* (2013.01); *A42B 3/30* (2013.01);
(Continued)

(58) Field of Classification Search
CPC G08B 21/0415; G08B 27/00; G08B 21/0446; G08B 21/0453; A42B 3/046; A42B 3/30; A42B 3/0453; A42B 3/0433
(Continued)

(56) References Cited

U.S. PATENT DOCUMENTS 5,697,099 A 12/1997 Siska et al.
6,657,543 B1 12/2003 Chung
(Continued)

FOREIGN PATENT DOCUMENTS

WO 2008/085511 7/2008
WO 2011/057306 5/2011

OTHER PUBLICATIONS

International Searching Authority/US, "International Search Report and Written Opinion" International Application No. PCT/US2015/055761, dated Jan. 8, 2016, 15 pages.
(Continued)

*Primary Examiner* — Anh V La

(74) *Attorney, Agent, or Firm* — Clement A. Berard, Esq.; Dann, Dorfman, Herrell & Skillman, PC

(57) ABSTRACT

Protective headgear for use in dangerous and/or hazardous locations may comprise: a headgear shell; a locator device on the headgear shell for providing location data; a motion sensor on the headgear shell for providing motion data; a memory on the headgear shell and having a unique identifier stored therein and configured to store the location data and the motion data; a transmitter-receiver for transmitting the location data, the motion data and the unique identifier to a remote database and for receiving notification data therefrom; and a user interface responsive to the received notification data to provide a visual notification or an audible notification or a physical notification or a combination thereof.

51 Claims, 7 Drawing Sheets

(51) Int. Cl.
*A42B 3/30* (2006.01)
*G08B 21/04* (2006.01)
*G08B 27/00* (2006.01)

(52) U.S. Cl.
CPC ..... *G08B 21/0415* (2013.01); *G08B 21/0446* (2013.01); *G08B 21/0453* (2013.01); *G08B 27/00* (2013.01)

(58) Field of Classification Search
USPC ..... 340/586, 573.1, 578, 539.1, 539.11, 340/539.13, 539.32; 2/422, 410
See application file for complete search history.

(56) References Cited

U.S. PATENT DOCUMENTS

| | | | | |
|---|---|---|---|---|
| 6,696,954 | B2 | 2/2004 | Chung | |
| 6,703,935 | B1 | 3/2004 | Chung et al. | |
| 6,883,710 | B2 | 4/2005 | Chung | |
| 6,943,688 | B2 | 9/2005 | Chung et al. | |
| 6,961,000 | B2 | 11/2005 | Chung | |
| 7,036,729 | B2 | 5/2006 | Chung | |
| 7,098,793 | B2 | 8/2006 | Chung | |
| 7,158,030 | B2 | 1/2007 | Chung | |
| 7,197,167 | B2 | 3/2007 | Chung et al. | |
| 7,221,269 | B2 | 5/2007 | Onderko et al. | |
| 7,319,397 | B2 | 1/2008 | Chung et al. | |
| 7,342,497 | B2 | 3/2008 | Chung et al. | |
| 7,382,255 | B2 | 6/2008 | Chung | |
| 7,423,535 | B2 | 9/2008 | Chung et al. | |
| 7,456,748 | B2 | 11/2008 | Chung et al. | |
| 7,501,954 | B1 | 3/2009 | Chung | |
| 7,508,308 | B2 | 3/2009 | Chung | |
| 7,513,425 | B2 | 4/2009 | Chung | |
| 7,561,724 | B2 | 7/2009 | Chung et al. | |
| 7,592,911 | B1 | 9/2009 | Hudgens et al. | |
| 7,623,036 | B2 | 11/2009 | Onderko et al. | |
| 7,813,934 | B1 | 10/2010 | Chung | |
| 7,839,289 | B2 | 11/2010 | Chung et al. | |
| 8,174,383 | B1 | 5/2012 | Chung et al. | |
| 8,686,861 | B2 | 4/2014 | Chung et al. | |
| 8,730,388 | B2 | 5/2014 | Osborn | |
| 9,082,284 | B2 | 7/2015 | Prieto | |
| 9,131,892 | B2 | 9/2015 | Markel | |
| 2006/0277666 | A1* | 12/2006 | Gertsch | A42B 3/04 2/424 |
| 2008/0091347 | A1 | 4/2008 | Tashiro | |
| 2009/0023421 | A1 | 1/2009 | Parkulo et al. | |
| 2009/0231423 | A1 | 9/2009 | Becker et al. | |
| 2012/0210498 | A1 | 8/2012 | Mack | |
| 2013/0215281 | A1* | 8/2013 | Hobby | G06F 3/005 348/207.1 |
| 2014/0052405 | A1* | 2/2014 | Wackym | G01P 15/00 702/141 |
| 2014/0375459 | A1* | 12/2014 | Curtis | G08B 21/02 340/573.1 |

OTHER PUBLICATIONS

Kevin Kwong-Tai Chung, et al. "Positive Train Control System and Apparatus Therefor", U.S. Appl. No. 14/817,836, filed Aug. 4, 2015, 92 pgs.

* cited by examiner

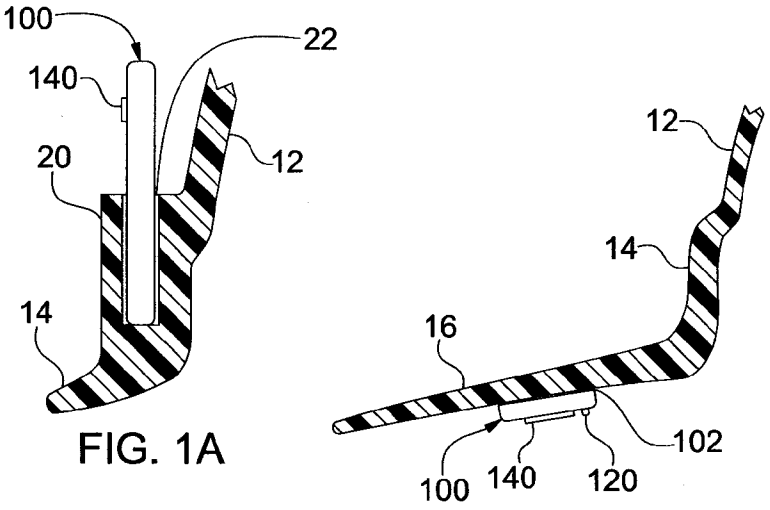
FIG. 1A
FIG. 1B
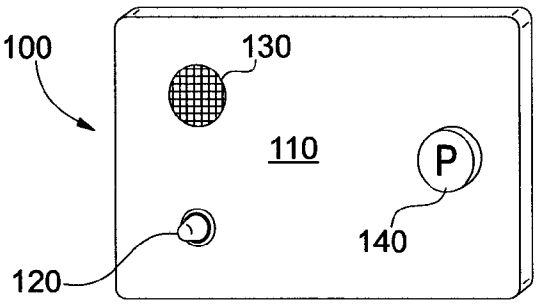
FIG. 2
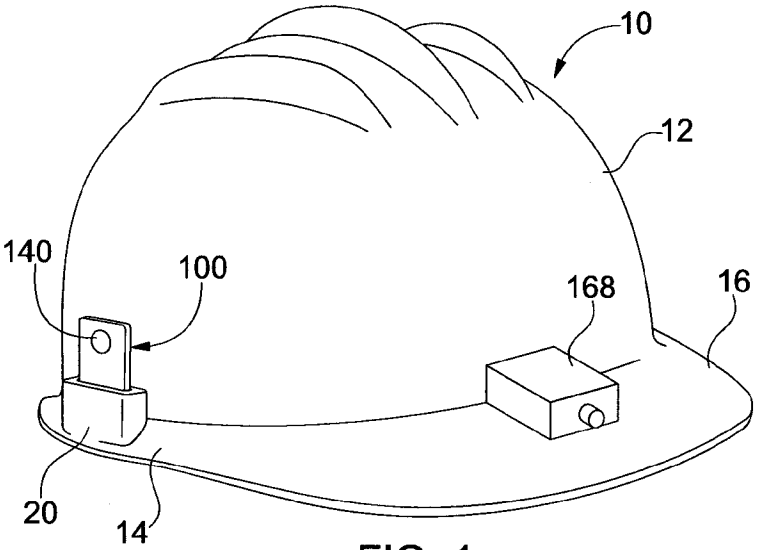
FIG. 1
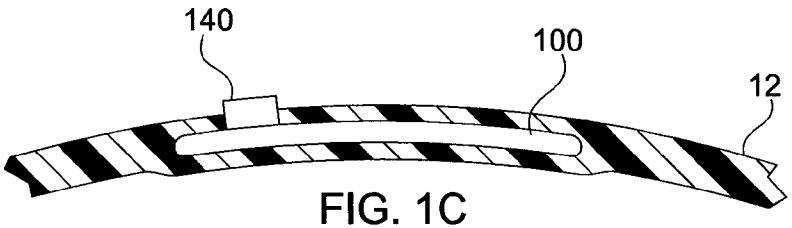
FIG. 1C

PROTECTIVE HEADGEAR INCLUDING A PERSONNEL ELECTRONIC MONITOR DEVICE

This Application claims the benefit of U.S. Provisional Application No. 62/122,345 filed Oct. 17, 2014, and entitled "Real-Time Locating and Sensor-Based Personnel Safety Monitoring and Reporting System For Hazardous Working Environment with Zonal Defined Physical Access Management," which is hereby incorporated herein by reference in its entirety.

The present invention relates to protective headgear and, in particular, to protective headgear including a personnel electronic monitor device (PEMD).

The following US Patents and Patent Publications relate to tracking systems and methods, are identified as background information, and are hereby incorporated herein by reference in their entireties:

U.S. Pat. No. 8,174,383 entitled "System and Method for Operating a Synchronized Digital Network."

U.S. Pat. No. 7,839,289 entitled "Object Monitoring, Locating, and Tracking System and Method Employing RFID Devices."

U.S. Pat. No. 7,813,934 entitled "Tracking Apparatus, as for an Exhibition."

U.S. Pat. No. 7,623,036 entitled "Adjusting Data Tag Readers With Feed-Forward Data."

U.S. Pat. No. 7,561,724 entitled "Registration Method, as for Voting."

U.S. Pat. No. 7,513,425 entitled "Article Tracking System and Method."

U.S. Pat. No. 7,508,308 entitled "Tracking Apparatus and Method, As For An Exhibition."

U.S. Pat. No. 7,501,954 entitled "Dual Circuit RF Identification Tags."

U.S. Pat. No. 7,456,748 entitled "RFID Antenna With Pre-Applied Adhesives."

U.S. Pat. No. 7,423,535 entitled "Object Monitoring, Locating, and Tracking Method Employing RFID Devices."

U.S. Pat. No. 7,382,255 entitled "Medical Assistance and Tracking Method Employing Smart Tags."

U.S. Pat. No. 7,342,497 entitled "Object Monitoring, Locating, and Tracking System Employing RFID Devices."

U.S. Pat. No. 7,319,397 entitled "RFID Device for Object Monitoring, Locating, and Tracking."

U.S. Pat. No. 7,221,269 entitled "Self-Adjusting Portals With Movable Data Tag Readers For Improved Reading of Data Tags."

U.S. Pat. No. 7,197,167 entitled "Registration Apparatus and Method, as for Voting."

U.S. Pat. No. 7,158,030 entitled "Medical Assistance and Tracking System And Method Employing Smart Tags."

U.S. Pat. No. 7,098,793 entitled "Tracking System and Method Employing Plural Smart Tags."

U.S. Pat. No. 7,036,729 entitled "Article Tracking Method and System."

U.S. Pat. No. 6,961,000 entitled "Smart Tag Data Encoding Method."

U.S. Pat. No. 6,943,688 entitled "Antenna Arrangement For RFID Smart Tags."

U.S. Pat. No. 6,883,710 entitled "Article Tracking System and Method."

U.S. Pat. No. 6,703,935 entitled "Antenna Arrangement For RFID Smart Tags."

U.S. Pat. No. 6,696,954 entitled "Antenna Array For RFID Smart Tags."

U.S. Pat. No. 6,657,543 entitled "Tracking Method and System, As For An Exhibition."

US Patent Publication 2016/0046308 of U.S. patent application Ser. No. 14/817,836 Filed Aug. 4, 2015, entitled "Positive Train Control System and Apparatus Therefor."

Many industrial sites and resource extraction sites, e.g., oil and gas drilling and/or fracking sites, off-shore drilling rigs, mines, chemical processing facilities, refineries, steel and other mills, employ or process various chemicals, gases, and other materials, and/or equipment, that are dangerous or hazardous to personnel and/or to equipment and/or to the environment. Equipment abnormalities, failures and accidents can and do happen, and can suddenly and unexpectedly release such dangerous and/or hazardous substances. In such locations it is desirable to know the location of personnel substantially in real time, as well as the status of such personnel at least at a basic level of whether the person is animated, as opposed to still. It is also desirable to provide an alert or warning or other notification to such personnel.

A conventional way of doing so often involves a personnel badge, e.g., an RFID tag, that responds to interrogation to identify the presence of personnel and for allowing the location of personnel to be determined, e.g., by triangulation, ranging or other method, at least to a moderate degree of accuracy. Personnel often supplement their personal RFID badges with a two-way radio for communication with other workers and local management, and/or may carry a cell or smart phone for communicating with local and/or remote management. However, carrying plural devices can be cumbersome and/or inconvenient.

Radio communication, e.g., two-way radios, often comes with the disadvantage that communications go to all personnel within range irrespective of whether or not the communication is relevant to those personnel, which can distract personnel from their task at hand and/or reduce efficiency. Cell and smart phones, on the other hand, provide one-to-one communication and so are not convenient for providing a warning or alert to all personnel in an area should a condition dangerous or hazardous suddenly arise.

In addition, locating schemes employing triangulation and/or ranging can be rendered inaccurate, unreliable and/or inoperative where there is a high level of electrical noise and/or interference, as is understood to be common at sites conducting fracking and other operations which involve high power electrical pumps and motors that generate such noise and interference.

Applicant believes there may be a need for protective headgear that can monitor and report substantially in real time its location and the status of the person wearing the protective headgear, and that can provide an alert or warning or other message for such person.

Accordingly, protective headgear for use in dangerous and/or hazardous locations may comprise: a headgear shell; a locator device on the headgear shell for providing location data; a motion sensor on the headgear shell for providing motion data; a memory on the headgear shell and having a unique identifier stored therein and configured to store the location data and the motion data; a transmitter-receiver for transmitting the location data, the motion data and the unique identifier to a remote database and for receiving notification data therefrom; and a user interface responsive to the received notification data to provide a visual notification or an audible notification or a physical notification or a combination thereof.

Further, protective headgear for use in dangerous and/or hazardous locations may comprise: a headgear shell; a locator device on the headgear shell for providing location data; a memory on the headgear shell and having a unique identifier stored therein and configured to store the location data; a transmitter-receiver for transmitting the location data and the unique identifier to a remote database and for receiving notification data therefrom; and a user interface responsive to the received notification data to provide a visual notification or an audible notification or a physical notification or a combination thereof.

Still further, protective headgear for use in dangerous and/or hazardous locations may comprise: a headgear shell; a locator device on the headgear shell for providing location data; a motion sensor on the headgear shell for providing motion data; a memory on the headgear shell and having a unique identifier stored therein and configured to store the location data and the motion data; a transmitter-receiver for transmitting the location data, the motion data and the unique identifier to a remote database.

In summarizing the arrangements described and/or claimed herein, a selection of concepts and/or elements and/or steps that are described in the detailed description herein may be made or simplified. Any summary is not intended to identify key features, elements and/or steps, or essential features, elements and/or steps, relating to the claimed subject matter, and so are not intended to be limiting and should not be construed to be limiting of or defining of the scope and breadth of the claimed subject matter.

BRIEF DESCRIPTION OF THE DRAWING

The detailed description of the preferred embodiment(s) will be more easily and better understood when read in conjunction with the FIGURES of the Drawing which include:

FIG. 1 is a perspective view of an example embodiment of a protective headgear including an example embodiment of a personnel electronic monitor device, and FIGS. 1A, 1B and 1C are partial cross-sectional views of the example protective headgear of FIG. 1 illustrating examples of mounting the example personnel electronic monitor device thereon;

FIG. 2 is a perspective view of the example personnel electronic monitor device of FIG. 1;

Figure 3:
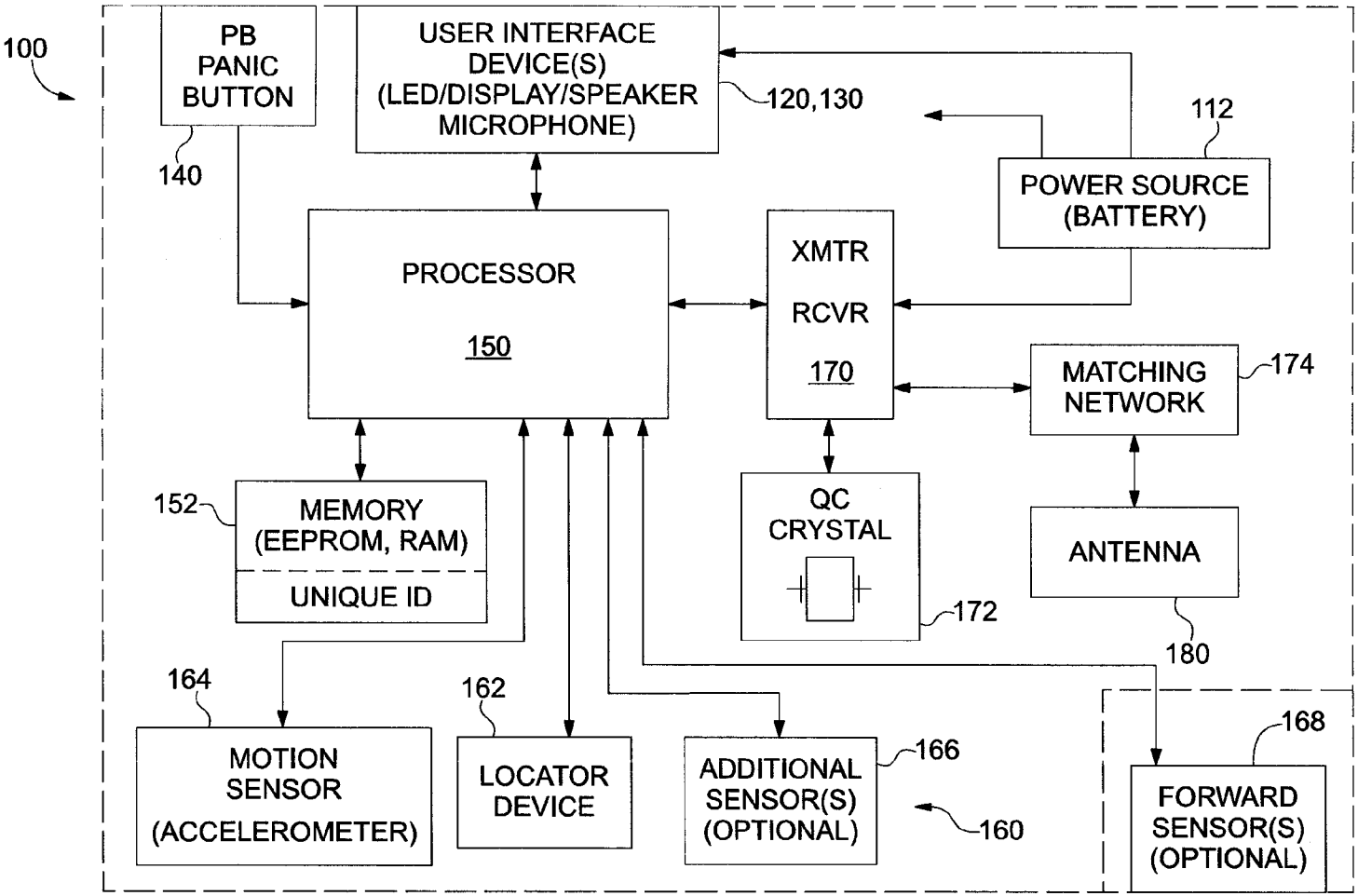
FIG. 3 is a schematic block diagram of an example embodiment of the example personnel electronic monitor device of FIG. 2.

In the Drawing, where an element or feature is shown in more than one drawing figure, the same alphanumeric designation may be used to designate such element or feature in each figure, and where a closely related or modified element is shown in a figure, the same alphanumerical designation may be primed or designated "a" or "b" or the like to designate the modified element or feature. Similar elements or features may be designated by like alphanumeric designations in different figures of the Drawing and with similar nomenclature in the specification. As is common, the various features of the drawing are not to scale, the dimensions of the various features may be arbitrarily expanded or reduced for clarity, and any value stated in any Figure is by way of example only.

DESCRIPTION OF THE PREFERRED EMBODIMENT(S)

FIG. 1 is a perspective view of an example embodiment of a protective headgear 10 including an example embodiment of a personnel electronic monitor device 100, and FIGS. 1A, 1B and 1C are partial cross-sectional views of the example protective headgear 10 of FIG. 1 illustrating examples of mounting the example personnel electronic monitor device 100 thereon, and FIG. 2 is a perspective view of one example personnel electronic monitor device 100 of FIG. 1. Protective headgear 10 includes a crown 12 having a narrow brim 14 around a portion of the lower edge thereof and a peak 16 extending from the remainder of the lower edge of crown 12.

Headgear shell 12 preferably has one or more receptacles 20 for receiving various items of use to the wearer of the headgear 10 such as personnel electronic monitor device (PEMD) 100. Receptacles 20 may be located, e.g., approximately over each of a typical wearer and at the rear of headgear 10. Typically, receptacles 20 provide recesses 22 that are open at the top and PEMD 100 may be inserted therein in a downward direction and may be retained therein by friction and/or gravity. Alternatively, PEMD 100 may be supported or attached under the peak 16 of headgear shell 12 and may be supported thereon by any suitable fastening arrangement, e.g., hook and loop fasteners such as VELCRO® material, adhesive, snap-in clips, screws, pins and the like.

In another alternative, PEMD 100 may be molded into headgear shell 12 or installed in a recess provided therein at a convenient location thereon, e.g., in crown 12 or in peak 16. In such instance, PEMD 100 is made in such as way as to be sufficiently flexible so that it can be conformed to the shape of the receiving location or recess of headgear shell 12, or may be made in a shape that conforms to the shape of the receiving location or recess.

In a preferred embodiment, PEMD 100 has an actuator 140 usable to call for assistance, e.g., a so-called "panic button" 140 or "Help On Demand" actuator 140, which is configured to be easily reachable while headgear 10 is being worn. Thus, when PEMD 100 is placed in an external receptacle 20, panic button 140 should face outward rather than inward where it would be difficult to reach because crown 12 would be in the way.

Typically, headgear shell 12 is stamped metal, e.g., aluminum or steel, or is molded of a tough durable strong plastic or composite material, typically one filled with fiberglass or other reinforcing material. Receptacles 20 are typically molded integrally with headgear shell 12, e.g., on the brim 14, 16 thereof, but may be attached by adhesive and/or another fastener. Where PEMD 100 is molded into headgear shell 12, an opening is provided therein to the exterior of headgear shell 12 for "panic button" 140 so that panic button 140 can be actuated from outside of headgear 10 when headgear 10 is being worn, e.g., on a head.

One example embodiment of PEMD 100 is in a generally rectangular enclosure or housing or case 110 that has as an example on one broad face a visual transducer 120, e.g., a light emitting diode (LED) 120, for providing a visual notification and/or an imaging device for capturing images, an audio (sound) transducer 130, e.g., a loudspeaker, buzzer, beeper, piezoelectric device, microphone, or other sound producing and/or receiving device 130, for providing an audible notification and/or receiving an audio input, and a "Help on Demand" or Panic Button" actuator 140 for initiating a communication requesting assistance when actuated, e.g., depressed.

When PEMD 100 employs transducers that can provide audible and/or visible notifications and/or receive visual and/or audible inputs, it provides PEMD 100 with the capability of two-way communication in substantially real time, e.g., of images and/or voice communication, which can substantially improve safety by enabling coordination between personnel in the field and monitoring and/or management personnel located elsewhere, e.g., in a monitoring station.

FIG. 3 is a schematic block diagram of an example embodiment of the example personnel electronic monitor device 100 of FIG. 2. Personnel electronic monitor device (PEMD) 100 includes a housing or case 110 which contains the various functional elements thereof. At the surface of housing 110 is a user interface 120, 130 that provides and receives audio and visual indications to and from a wearer of protective headgear 100 including PEMD 100. User interface 120, 130 includes visual transducer 120, and audio or sound transducer 130. Importantly, each PEMD 100 has a unique identifier stored therein that is associated with each transmission made by PEMD 100 so as to become associated with data generated by PEMD 100 and to remain associated with that data when that data is stored in PEMD 100 as well as in a relational database that receives such data.

Visual transducer 120 is coupled to processor 150 for receiving signals representing visual indications and/or notifications, e.g., instructions, alerts and warnings, to be provided to a wearer of protective headgear 10, and preferably also for communicating signals representing video images to processor 150. Visual transducer 120 may include a light, LED, LCD display, a flashing light, a light producing different colors, or other visually perceptible device that may be used to provide a notification, and different visual devices may be utilized to provide different kinds of notifications, e.g., messages, alerts and warnings. For example, a flashing amber light may be used to communicate an alert and a flashing red light a warning; a display screen may be used to communicate what the alert or warning is and what action should be taken. Visual transducer 120 may be utilized independently of or in conjunction with any other user interface device. Visual transducer 120 may also include an imaging device to capture images, e.g., still and/or video images, for transmission to a monitoring station, thereby to enable monitors and/or managers at a remote location to "see" what field personnel are seeing.

Audio or sound transducer 130 is coupled to processor 150 for receiving signals representing audio indications and/or notifications, respectively, e.g., instructions, alerts and warnings, to be provided to a wearer of protective headgear 10, and for communicating signals representing images and/or video images to processor 150. Processor 150 in turn couples the audio and/or visual signals to memory 152 to be stored and/or to transmitter 170 to be communicated to a monitoring system. Sound transducer 130 may include a buzzer, beeper, annunciator, loudspeaker, earphone or other audibly perceptible device that may be used to provide a notification, and different audible devices may be utilized to provide different kinds of notifications, e.g., messages, alerts and warnings. For example, an on/off buzz or tone may be used to communicate an alert and a different on/off or continuous buzz or tone a warning; a loudspeaker or earphone may be used to communicate the alert or warning and/or what the alert or warning is and what action should be taken. Audible transducer 130 may be utilized independently of or in conjunction with any other user interface device.

Sound transducer 130 may also include a microphone or other sound pick up device of any kind so that sound at the location of PEMD 100 can be communicated to command center 228, 246, 290, or another monitoring station, e.g., to evaluate a situation where a lack of movement condition has been detected by motion sensor 164 and reported, and/or so that two way voice communication between a wearer of headgear 10 and command center 228, 246, and/or 290 can be established, and so that two-way voice communication may be provided when necessary between personnel, e.g., to coordinate actions.

Help on Demand or panic button actuator 140 is coupled to processor 150 for signaling, when actuated, that a call for help or assistance is to be initiated, and processor 150 couples that signal to transmitter 170 to be communicated to a monitoring system.

Sensor elements 160 include at least two sensors—a locator device 162 and a motion sensor 164. A locator device 162, e.g., a global positioning system receiver, preferably determines the location of PEMD 100 and protective headgear 10 from precise and reliable signals provided by an external source such as a satellite navigation system. Suitable and available location determining satellite systems include, e.g., the US Global Positioning System (GPS), the Russian GLONASS system, the European Galileo system, the Indian IRNSS system and/or the Chinese BDS system. A preferred locator device 162 utilizes the US GPS system with Wide Area Augmentation System (WAAS) which augments GPS to improve its locating accuracy to within about three meters (conservatively), and typically to within one meter horizontally and 1.5 meters vertically, where it is available, e.g., primarily in the continental United States, Alaska and Canada. The terms "global positioning system" and "GPS" are used herein to refer generically to any system for determining location from signals transmitted from a remote source, e.g., from an earth orbiting satellite, unless specifically stated otherwise, e.g., as in the "US GPS" system.

While two or more different and independent global positioning system receivers could be employed so that geographic location data is available even when one GPS system is out of range or out of service, the power consumption of locator device 162 may render such duplication impractical at present due to the limited capacity of battery 112. Alternatively, and in some instances preferably, locator device 162 may employ an inertial sensor, e.g., a gyroscopic device or accelerometer, to supplement the GPS locating device so that location data is provided substantially continuously even though signals from the GPS satellites may be obscured, masked, or interrupted.

Further, supplemental location data may be obtained by monitoring the strength and/or triangulation of signals transmitted by transmitter-receiver 170, e.g., a received signal strength indication (RSSI) from WiFi and/or Bluetooth and/or other protocol signals, received at PEMD 100 and/or at a relay 250 and/or monitoring station 310, 228, 246, so that location data is provided substantially continuously even though signals from the GPS satellites may be obscured, masked, or interrupted. The RSSI locating device and trilateration (or triangulation) function may be provided by processor 150 in conjunction with transmitter-receiver 170 and may be considered as part of locator device 162, of motion sensor 164 and/or of any other sensor 160, 166. An example of an RSSI based locating system and method is described in U.S. Pat. No. 7,342,497 entitled "Object Monitoring, Locating, and Tracking System Employing RFID Devices" which is hereby incorporated herein in its entirety by reference.

While locator 162 could use triangulation and/or signal strength and/or propagation delay as a primary way to determine location, these methods, however, are not preferred as the primary way for locating PEMD 100 due to their susceptibility to radio frequency (RF) interference, signal disruption and error, as well as their lesser accuracy, but are thought suitable as a secondary was in the absence of GPS signals. Further, a GPS locator does not require infrastructure at the site, e.g., RF signal and communication relaying devices, to facilitate determining of the location of the PEMDS 100 therein.

Preferably, the site will be mapped to determine the GPS coordinates of various areas, boundaries, restrictions, equipment and other items therein so that the location provided by GPS locator device 162 can be used to monitor personnel location in relation to such areas and items, so that access thereto may be monitored and controlled, and appropriate action may be taken (via a remote monitoring system) if personnel move into an unauthorized or hazardous area, or are not in an appropriate area, or are not in an areas where they are supposed to be in. Personnel who enter into an area that should not enter will thus receive a notification to exit such area; and personnel who are not in an area that they should be in will thus receive a notification to go to such area.

Motion sensor 164 is typically an accelerometer or pendulum or other device that senses and detects small movements of protective headgear 10 and PEMD 100 as a wearer thereof would make if animated, e.g., in moving, looking around and/or talking and the like, or is substantially motionless. When sensor 164 detects such motion, which is an indication that the wearer is animated, e.g., is normal or in good condition, no action is required, however, the motion data may be and preferably is stored in memory 152 which also has the unique identifier of PEMD 100 stored therein and preferably associated with the location data and motion data.

If, however, the wearer is substantially motionless, e.g., asleep, injured, incapacitated, unconscious or otherwise not moving, such condition is likely indicative of a need for assistance whereupon a visual and/or audible notification could be sent to PEMD 100 (via a remote monitoring system) to elicit a response and/or assistance could be dispatched. Thus, motion sensor 164 provides an ongoing indication of the status (health) of the wearer of protective headgear 10 and PEMD 100 that is associated with the unique identifier of PEMD 100 and the protective headgear with which it is associated, and a lack of motion data for more than a predetermined period of time, e.g., more than about five seconds, and preferably between about five seconds and about 30 seconds, is thought to provide a reliable indication that a motionless personnel is likely in need of assistance.

Sensor elements 160 may typically, but optionally, include one or more other sensors 166, e.g., sensors 166 that monitor health-indicating characteristics of personnel, ambient conditions, hazardous substances and/or conditions, the environment, and the like. Examples of sensors 166 include sensors of environmental conditions, temperature, pressure, position, acceleration, impact, distance, gyroscopic and/or inertial information, magnetic field, electrical continuity, altitude, a physical parameter, moisture, humidity, chemicals, gases, medical parameters, biological substances and/or agents, radioactivity, optical, light, infrared, images, still and/or video images, sound, noise, electromagnetic fields, and the like, and any combination of any two or more thereof.

Such sensors may detect the presence and/or absence of what is sensed, or may quantify the level or intensity of what is sensed, or both. Sensor 160 data is associated with the unique identifier of PEMD 100. For example, where PEMD 100 will be used at a site where natural gases may be present, sensors 166 are preferred to include sensors for methane and for hydrogen-sulfide. While it is preferred that such sensors 166 be contained within housing 110, certain sensors require exposure to the environment, e.g., atmosphere, to operate, and so may be so exposed via an opening in housing for that purpose, e.g., a dedicated opening that is configured to have a sensor's sensing element adjacent thereto, or by being mounted externally to housing 110, e.g., on the exterior thereof or on the exterior of headgear shell 12.

In addition, PEMD 100 may optionally include one or more sensors 168 having a field of view outward from headgear 10 for sensing conditions in a predetermined direction relative to headgear 10, e.g., most commonly in a "forward looking" direction. Sensors 168 may be included in housing 110 of PEMD 100 or may be separately mounted on headgear 10, e.g., on the crown or peak 16 of headgear shell 12. Optional sensors 168 include a forward looking radar 168 operating, e.g., on Doppler principles or an ultrasonic or optical (e.g., laser) distance measuring and/or object sensing device 168. Optional sensors 168 also include an imager 168 for capturing still and/or video images (in two or three dimensions) forward of headgear 10 and/or a directional microphone 168 so that monitoring personnel in a remote monitoring station can see and/or hear substantially what the personnel wearing headgear 10 is seeing and/or hearing substantially in real time. Preferably, when sensor 168 includes an imager 168 and/or a microphone 168, processor 150 of PEMD 100 processes the received signals and stores (records) them in memory 152, as well as coupling them to transmitter-receiver 170 for transmission to monitoring station, preferably substantially in real time.

Data from the additional sensors 166,168 is also associated with the unique identifier of the PEMD 100 and are transmitted to via a remote monitoring system which in turn returns a notification, e.g., alert or warning, activating one or more of the devices associated with user interface 120, 130 should any data from sensors 166,168 indicate a condition deemed to warrant such notification. In cases where the danger or hazard may affect other personnel, areas, the environment and/or equipment, notification may also be sent to PEMDS 100 associated with other personnel, in general or by their location within site 200.

In addition, where any sensor 166 detects a condition that is deemed dangerous or hazardous, e.g., to personnel, the environment, equipment, or otherwise, notification thereof may be provided via user interface 120, 130, alternatively and/or in addition being communicated via transmitter-receiver 170 for providing notification thereof to site management and/or other personnel.

Transmitter-receiver 170 includes a transmitter that is coupled to processor 150 for receiving from processor 150 and memory 152 the unique identifier of PEMD 100 and data to be transmitted via matching network 174 and antenna 180 which are contained in housing 110. Transmitter-receiver 170 also includes a receiver that is coupled to via matching network 174 to antenna 180 for receiving data signals thereat that are coupled to processor 150 to be processed thereby and/or stored in memory 152, and received data may be identified by including in the received data the unique identifier of the PEMD 100 to which it is intended to be sent.

A crystal 172, or other frequency setting device 172, is provided to control the operating frequency of transmitter-receiver 170 so that data is transmitted and received at a predetermined frequency or frequencies, e.g., at about 433 MHz. Crystal 172 may also be utilized to control the clocking signals of processor 150, e.g., if processor 150 does not include a clock generator.

Memory 152 coupled to processor 150 may include volatile and/or non-volatile memory, e.g., EEPROM and/or RAM memory, for storing operating instructions for processor 150 by which operation of PEMD 100 is controlled, and for storing data captured by PEMD 100, e.g., by elements 120, 130, 140, 160 thereof and/or received by PEMD 100 via antenna 180 and receiver 170.

Data generated by PEMD 100, e.g., generated by elements 120, 130, 140, 160 thereof, is processed and transmitted substantially in real time, i.e. with in less than a few seconds, and preferably in less than one second, of when it is generated, whether provided directly to transmitter 170 by processor 150 or indirectly via processor 150 and memory 152. The data generated by PEMD 100 is associated in memory 152 with the unique identifier of that PEMD 100 and so is related thereto to be uniquely identified therewith when transmitted.

Because GPS signals include precision time data, accurate time data is available and is preferably utilized to associate a date-time stamp with each data produced by PEMD 100. Thus, the combination of location data of locator device 162 and the accurate time data, all location data, motion sensor data and other sensor data may be and preferably is both geo-tagged to the location of PEMD 100 and accurate time. Also preferably, time data, e.g., a date-time stamp, is communicated along with location data, motion sensor data and other data transmitted from PEMD 100.

Power source 112 typically includes a battery 112 with sufficient capacity to power PEMD 100 for at least 1.5 times the normal working period, e.g., shift, whether that be an 8-hour shift or a 16-hour shift. Power source 112 is preferable rechargeable, and desirably is exchangeable for a replacement, so that quick return to service with a full charge may be provided. For one example embodiment, a battery providing about 5 VDC and having a capacity in the range of about 3-6 W-Hr is expected to be adequate.

Where protective headgear shell 12 has plural receptacles 20, one or more extra fully charged batteries 12 may be carried in an otherwise unused receptacle 20 using a suitable case or housing. Regular and periodic recharging may be implemented by charger receptacles that receive complete headgear 10 in a position such that charging power is applied to battery 112, or by charging receptacles for individual or plural PEMDS 100, or by charging receptacles for individual or plural batteries 112. Preferably, the number of batteries 112 provided is sufficient for all of PEMDS 100 to have an operating battery 112 installed therein and for at least a like number of batteries 112 to be simultaneously charging in one or more battery charging receptacles.

Additionally, and/or optionally, supplemental power may be provided by solar cells attached to the exterior of shell 12 of protective headgear 10, and the solar cells when operating at peak output should provide about two times, and preferably about three times, the total operating power or PEMD 100 so that substantial recharging of batteries 112 may be provided. Preferably, the solar cells are attached in positions on shell 12 to maintain a comfortable weight balance of headgear 10 on a user's head, and by a suitable adhesive, e.g., a pressure sensitive foam having a peel strength of over 20 grams per inch, so that they do not move relative to shell 12.

Figure 4:
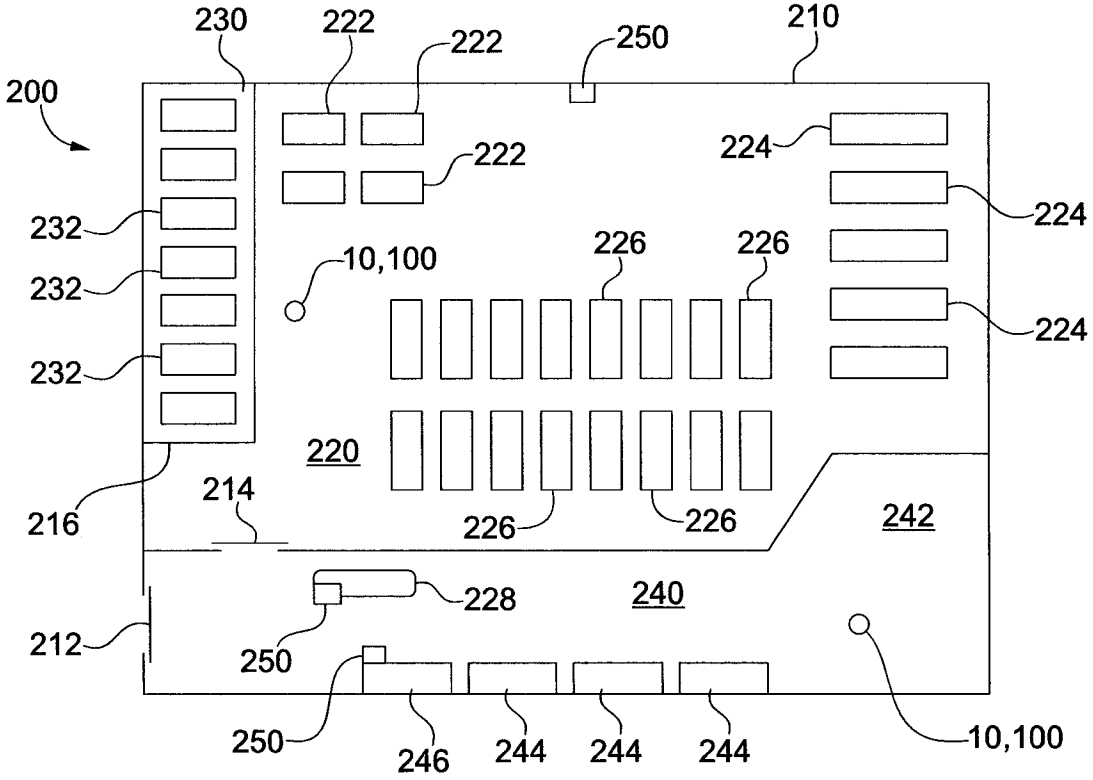
FIG. 4 is a plan view of an example location or site whereat the example protective headgear of FIG. 1 may be employed.

FIG. 4 is a plan view of an example location 200 or site 200 whereat the example protective headgear 10, 100 of FIG. 1 may be employed. For safety and for security, access to site 200 must be controlled and the location and status of personnel at the site must be monitored, and notifications, e.g., alerts, instructions, and warnings, should be sent should an untoward condition occur, e.g., a release of a chemical or gas, a fire and/or explosion, an intrusion, or other condition that puts personnel safety or site safety or the environment at risk.

Example site 200 is for purposes of illustration and description, and may not conform to or represent any actual site. Illustrative site 200 is typically a site whereat hazardous and/or dangerous activities are conducted, e.g., drilling for oil or gas, or fracking (hydraulic fracturing intended to release an underground resource), producing and/or processing hazardous materials, and the like, and is typically surrounded by a perimeter fence 210 having a entryway or gate 212 through which vehicles and/or equipment may enter and exit, and to keep non-authorized person out for safety and security.

Inside perimeter fence 210, various portions of site 200 may be designated for different operations and storage, such as site management, site and safety monitoring, drilling, processing, equipment usage, equipment storage, chemical and gas storage, personnel housing, and the like, and certain areas, e.g., storage area 230, may be separately fenced 216 to limit access to storage containers and/or equipment 232 therein, whether fixed in place or movable.

In general, the principal operations conducted at site 200 would generally be conducted in a central region 220 thereof and supporting operations, reserve and storage would generally be placed nearer the periphery thereof. For example, a way for vehicle access 240 may be provided along an edge of site 200, including a turn-around area 240 at a convenient place, so that vehicles transporting supplies and equipment and the like to site 200 and/or removing product, supplies, equipment, expended items, trash and the like, have sufficient room to enter, maneuver, load and unload and exit.

Buildings 244, 246, which may be temporary or permanent, may be located in or near the vehicle access way 240 and/or turn around 242 where they are convenient to the site operations, and yet in a place not to interfere therewith. One building, e.g., building 246, may be utilized for site monitoring and management, a command center and/or a management office, while other buildings, e.g., buildings 244 may be utilized for personnel, e.g., for housing, dormitories, food service, recreation, on-site infirmary or clinic, training, and the like. A mobile command center 228, e.g., an "Alpha Dog" trailer, may also be utilized, either in conjunction with command center 228 or in parallel therewith, or in place thereof, as my be deemed convenient and appropriate.

Personnel entering site 200 via gate 212 or work area 220 via gate 214 should be checked for authorization to enter, e.g., using PEMD 100 and/or a personal identification badge. In addition, personnel entering work area 220 or any other dangerous and/or hazardous area, e.g., a "hard hat" area, should be checked to see that they are wearing their protective headgear 10 and that their PEMD 100 is active and operating. Identity may also be verified using their personnel identification badge, facial recognition, fingerprint scan or other means of positive identification. While manual and/or automated verification may be employed, the use of verifiable automated verification, e.g., video of the worker and his headgear, is thought to be preferred.

Access to the site 200, work area 220, command center 228, storage area 230 and buildings 244, 246 is to be limited based upon personnel duties and responsibilities (sometimes referred to as "role-based" access), so that only personnel having a need to be in any particular area are authorized for such area, whereby personnel in unauthorized areas or out of their area can be automatically identified and receive appropriate notification via user interface 120, 130, and a management notification can also be provided, e.g., to command center 228 and/or management office 246. Such automated personnel locating and notification is preferably provided by a monitoring system as described herein.

It is noted that with the GPS locating described, each area is preferably defined by GPS coordinates and as operations move and/or change, area access can be appropriately modified by changing the GPS coordinates for such areas. As such, an "area" can be static, e.g., in a fixed location, or can be dynamic, e.g., move along with a change in operations and/or movement of supplies and/or equipment.

Thus, for example, as a tanker containing a hazardous material moves through gate 212 into access way 240, and then through gate 212 into work area 220, the restricted access area surrounding that tanker can be moved simply by changing its GPS coordinates. Where a GPS locator, e.g., a PEMD 100 is attached to the tanker, its location coordinates are transmitted substantially in real time to command center 228, 246 whereat the computer or server monitoring things and activities at site 200 can translate the GPS coordinates of the restricted are so that the restricted area moves with the tanker substantially at its center. As a result, notifications are automatically provided to management of unauthorized personnel being near the tanker and to personnel who are in a place that they should leave because it has become unauthorized for them due to tanker movement.

In addition to fenced storage area 230, storage of equipment and supplies may be provided in any area near the periphery that is not needed for the operations conducted at site 200, and plural storage areas 222, 224, may be provided in different locations. One storage area, e.g., area 222, might be used to store consumable supplies, e.g., water and chemicals for fracking operations, in fixed and/or mobile storage containers 222, e.g., tanks or tankers, or area 222 may contain support equipment 222 for the main site operation being conducted in a nearby, e.g., central, area. Area 224 might be used to store equipment 224, e.g., pumps, mixers, blenders, drilling rigs, cranes and/or forklifts, that support the central operation or perform an auxiliary operation. Equipment 226 of different sorts may be placed centrally to perform the main operation performed at the site 200, e.g., drilling, pumping water and chemicals and/or extracting product, and the like.

At one or more locations of site 200 are placed communication devices 250 that communicate with protective headgear 10, 100, and specifically the personnel electronic monitor device (PEMD) of each protective headgear 10 for relaying data and other communication from and to PEMDS 100. Each device 250 provides communication between any personnel electronic monitor device (PEMD) on site 200 to a central database, e.g., on a computer of server located on or near the site 200, e.g., in mobile command center 228 and/or in command center 246, or located remote from site 200. Communication devices 250 may be placed on fence 210, on free-standing posts, poles and/or towers, on equipment or any other place through which suitable communication can be established.

Preferably, each communication device 250 includes an independent source of back-up power sufficient to operate device 250 for at least three days, and preferably for at least seven days. Back-up power therefor may be provided by batteries and/or by solar cell panels. Power from AC mains that operates communication device 250 and/or the solar cell panels can be used to maintain the back-up batteries fully charged.

Communication devices 250, e.g., relay devices 250, may use any type or kind of communication and/or any communication protocol compatible with PEMDS 100 for communicating data, signaling, voice and other messages thereto and therefrom. Relay devices 250 may include a wireless radio transmission interface that includes functionality for cooperating with other relay devices to establish and maintain an ad hoc network wherein relay devices cooperate to relay reports of received identifying information from PEMDS 100 to command station 228, 246. Relay devices 250 may be WiFi routers or "hot spots," or cellular and/or mobile telephone type towers, 3G and 4G links, and the like.

Examples of wireless communication and network interfaces that may be employed include, but are not limited to, known network technology and protocols such as an IEEE 802.11x type network, an IEEE 802.15.x type network, a Bluetooth network, a "Wi-Fi" network, a "ZigBee" type network, an EmberNet ad hoc network (Ember Corporation, Boston, Mass.), RFID communication, microwave and/or fiberoptic links, a cellular network, a satellite network, as well as any other present and/or future communication and network technology and protocols. The forgoing may be supplemented by Internet and/or telephone access, if and as available. Combinations of any or all of the foregoing types and kinds of communication may be employed in provided the communication between and among the elements described herein.

Preferably, communication relay devices 250 will employ a communication protocol that has substantial range so that fewer devices 250 will be required. For this reason a WiFi or similar protocol is preferred in combination with the described PEMDS 100 employing GPS locator devices 162 over, e.g., an RFID protocol, where a larger number of relay devices 250 is necessary to obtain a suitable PEMD locating accuracy. For a typical site 200, between one and four communication relays 250 should be sufficient. In this preferred arrangement, the higher cost and complexity of needing many RFID relays is avoided by using a simpler and less expensive WiFi network that covers a larger area, which tends to offset the additional cost of using a GPS locator 162 in PEMDS 100. Also, the increased operational, efficiency and safety resulting from using more accurate GPS locating is likely to be seen as being worth the cost of implementing GPS locating in each PEMD 100.

Figure 5:
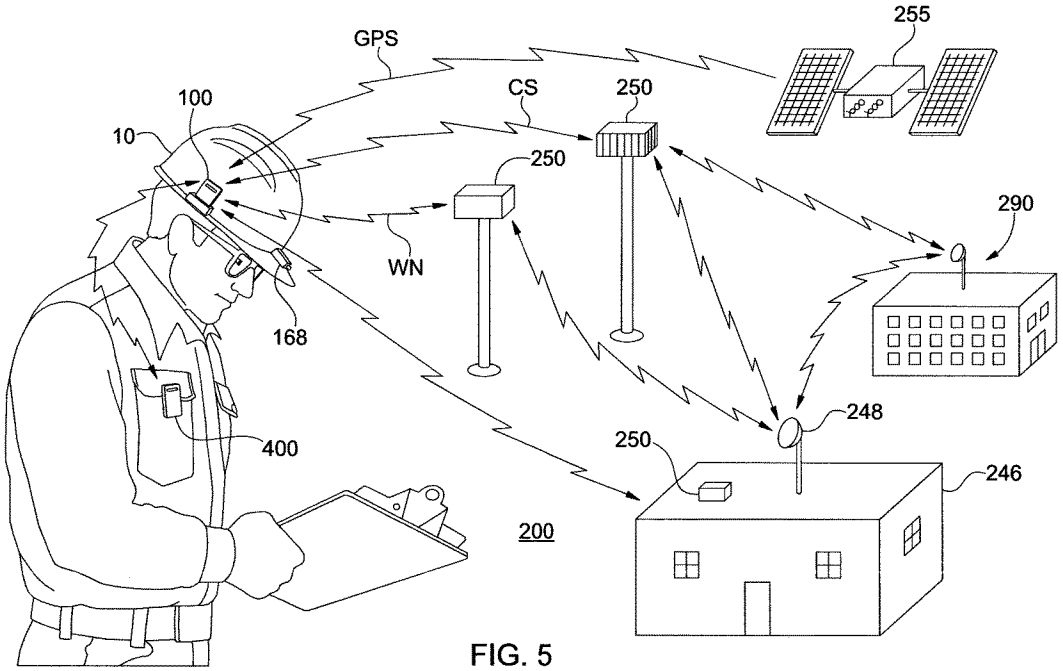
FIG. 5 is a schematic diagram illustrating the example protective headgear employed at an example location or site and in conjunction with an example embodiment of a personnel identification badge.

FIG. 5 is a schematic diagram illustrating the example protective headgear 10, 100 employed at an example location or site 200 and in conjunction with an example embodiment of a personnel identification badge 400. Protective headgear 10, personnel electronic monitoring devices (PEMD) 100, and site 200 are typically as described herein. Communication devices 250 may be a WiFi node 250 which provides and communicates via a wireless network WN or may be a mobile or cellular device 250 which provides and communicates via a cellular network CS.

Communication between elements 100, 250, 228, 246 at site 200 and a central facility 290, e.g., including one or more servers and/or computers that process data, create and maintain a relational database of all data transmitted thereto, generate and dispatch alerts, instructions, warnings and other notifications directly or indirectly to PEMDS 100 as needed. Central facility 290 may communicate via microwave link, cellular network and/or any other type or kind of communication link with on-site command center 228 (e.g., via a communication antenna 248), 246. Communication links and paths are indicated schematically by jagged double-ended arrows, which in the case of communication between fixed structures may include physical links such as fiberoptic and electrical cables in addition to wireless communications (every possible path may not be shown).

Also illustrated is an example satellite 255 which is one of several that are part of a multiple satellite-based locating system of the types described herein, e.g., the US GPS satellites, and that transmit precise position and time signals from which the locator device 162 of each PEMD 100 can accurately determine its position substantially in real-time, so that PEMD 100 location data can be transmitted substantially in real time.

Personnel (worker) 30 carries, in addition to PEMD 100 of his headgear 10, a personnel identification badge 400 which includes electronic circuitry for communicating with PEMD 100, e.g., using RFID technology, Bluetooth, ZigBee or any other suitable communication protocol, and via PEMD 100 with one or more of command center 228, 246 and remote facility 290. Each personnel identification badge 400 has a unique identifier stored therein which is associated with all data generated and all data transmitted by each badge 400, and so each badge 400 and its unique identifier is associated with the person to whom the badge 400 is issued, and with the protective headgear 10 and PEMD 100 used by such person.

While each PEMD 100 is associated with a particular article of protective headgear 10, that particular headgear 10 and/or PEMD 100 may or may not always be associated with a particular person 30, even if it is assigned to and intended to be worn by a particular person 30. Typically headgear 10 tend to look alike and so can easily be mixed up, even if unintentionally, and so may not reliably serve to identify the particular person 30 who is wearing any particular article of headgear 10. That ambiguity tends to be reduced, if not avoided and resolved, because the unique identifier of each personnel identification badge 400 is associated with the data generated and transmitted by the PEMD 100 used by the person carrying a personnel identification badge 400.

Personnel identification badge 400 is, however, more closely associated with a particular person because it is typically used for controlling access, work attendance and work time recording, e.g., to clock workers 30 in and out, and thus affects their being paid, so each worker 30 has a personal incentive to safeguard and retain his identification badge 400 in his personal possession. Thus, badge 400 is seen to be a more reliable and consistent means for personnel identification and monitoring. When badge 400 and PEMD 100 communicate, their respective unique identifiers are relationally associated with each other, and are communicated to command center 228, 246 and/or at central facility 290, so the monitoring and tracking relational database at command center 228, 246 and/or at central facility 290 relates a particular badge 400 (and thus the worker 30 to whom it is issued) to a particular PEMD 100 (preferably, but not necessarily, the PEMD 100 intended to be carried by and associated with a worker's headgear 10).

Either or both of headgear 10 with PEMD 100 and personnel badge 400 may be utilized for controlling access into and out of site 200, as well as into and out of any area or gate or facility therein. Typically badge 400 employs a communication protocol and power level that affords a relatively short range (e.g., relative to the size of site 200) and so would be passed relatively closely to a badge reader, e.g., at a gate 212, 214 or other access control station. Preferably, when personnel seek access, the respective unique identifiers of their badge 400 and PEMD 100 are associated with each other so that real time monitoring of PEMDS 100 will also encompass real time monitoring of particular personnel.

Figure 6:
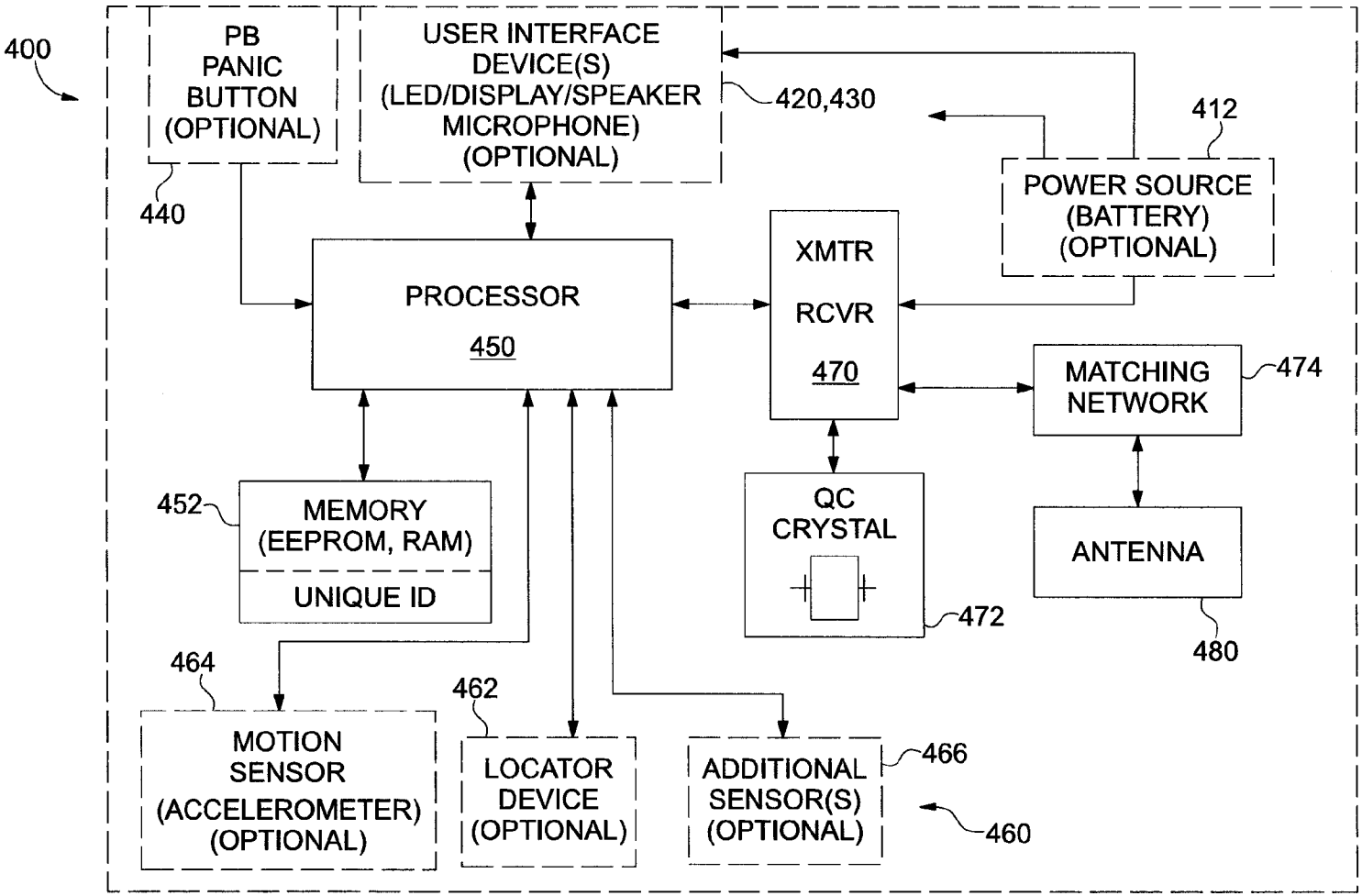
FIG. 6 is a schematic block diagram of an example embodiment of a personnel identification badge employed in conjunction with the example personnel electronic monitor device of FIG. 2.

FIG. 6 is a schematic block diagram of an example embodiment of a personnel identification badge 400 that may be employed in conjunction with the example protective headgear 10, 100 of FIG. 2. In general, the elements and functions of badge 400 are substantially similar to those of PEMD 100 except that certain elements found in PEMD 100 may be, and preferably are, eliminated, as indicated by their being shown in dashed line, and certain operating differences may be made as described.

Badge 400 may in some instances be the same functionally as PEMD 100 and may be contained in housing of a different configuration or of the same configuration as is PEMD 100. In this instance, it is preferred that badge 400 become associated with the headgear 10 and PEMD 100 of one person by associating their respective unique identifiers and thereafter maintaining that associational relationship so that data from both devices 100 and 400 is linked and can be compared for increasing confidence in the accuracy thereof or the duplicative data may simply be deleted once confirmed to be duplicative.

For example, where badge 400 is to be utilized only for identification and access control purposes, it operates similarly to an RFID tag (although another form of communication protocol may be utilized) and user interface devices 420, 430 are not needed and may be eliminated as may panic button 440. Regarding sensors 460 in such instance, locator device 462 and motion sensor 464 also are not needed and may be eliminated, as may any other (optional) sensors 466. Further, processor 450 is so simple that it substantially is no longer a processor, but simply a comparator for comparing a received RFID identifier to the unique identifier stored in memory 452 (which itself is a very minimal memory), and producing a response code from memory 452 if the received RFID identifier matches the stored unique identifier of badge 400.

Badge 400 is an identification device that may be configured in any of many different forms, e.g., a badge, tag, card, clip, lanyard, wristband, embedded device, whether removably or permanently attachable, or in any other convenient form, shape or size that can be carried by a person. It is also noted that badge 400 may employ the same circuit and structure as PEMD 100 although certain functions and/or elements thereof may be modified, deactivated or removed. In certain configurations, e.g., where the transmitter-receiver 470 is a passive responder, as in passive RFID tag technology that responds only when interrogated using energy captured from the interrogation signal, battery 412 is not needed and so may also be eliminated. In other configurations, the battery 412 is retained if the recharging and/or replacement of a battery 412 therein is acceptable in regards to a personnel ID badge.

Communication between badge 400 and PEMD 100 is preferably via wireless communication having a relatively short range that is more than sufficient for the typical distance, e.g., about 12-36 inches (about 0.3 to 1 meter) between the head (headgear 10) and belt or pocket (pants or shirt), of the person wearing both that badge 400 and that PEMD 100. Thus, badge 400 and PEMD 100 may communicate via an RFID or BlueTooth protocol, or a similar protocol. Preferably, once a particular PEMD 100 is associated with a person and his personnel identification badge 400, and their respective unique identifiers, communication therebetween includes one or both of those identifiers so that each positively recognizes and communicates only with the appropriate other one.

Figure 7:
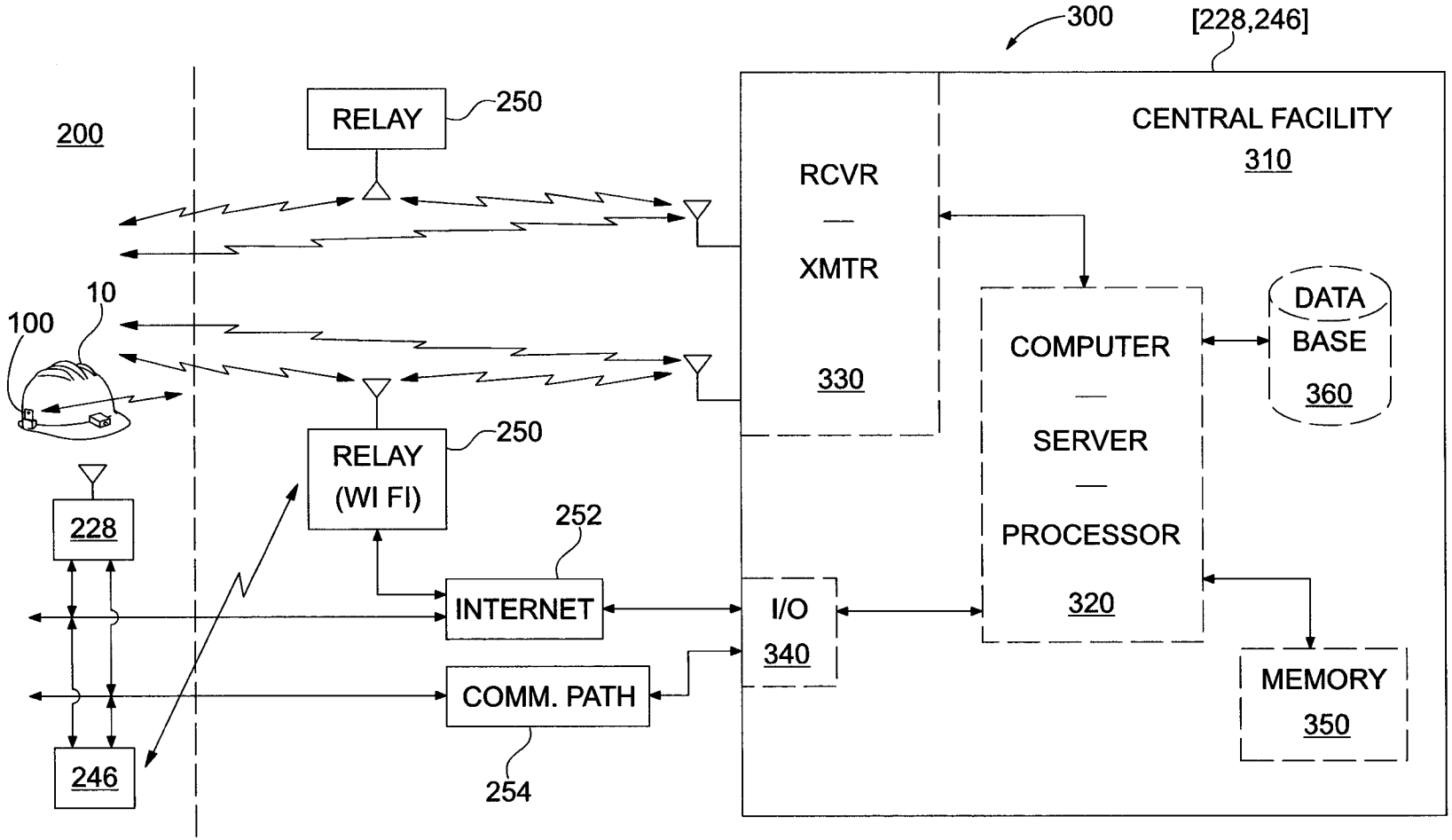
FIG. 7 is a schematic diagram of an example embodiment of a remote monitoring station suitable for use with the example devices of FIGS. 1-6.

FIG. 7 is a schematic diagram of an example embodiment of a remote monitoring station and system 300 suitable for use with the example devices 100 of FIGS. 1-6. System 300 includes a monitoring station 310, e.g., a central monitoring facility 310 which may be separate from and/or in addition to command centers 228, 246, or may be command center 228, command center 246, or command centers 228 and 246. Monitoring station 310, e.g., a central facility 310 and/or a command center 228, 246, includes a processor 320 which may be a server, a computer, a laptop computer or any other computer processor suitable for adding records to, relating records stored in, generating notifications from, and maintaining, a relational database.

Monitoring station 310 includes communication resources such as wireless receiver-transmitter 330 by which data is received wirelessly (illustrated schematically by double-ended jagged arrows) from one or more PEMDS 100 either directly or indirectly via one or more relays 250 or via a command center 228, 246. Facility/center 310 also includes communication resources such as input-output device 340 by which data is received from PEMDS 100 either via the Internet 252 or via one or more other communication paths 254 indirectly via one or more relays 250 and/or via command centers 228, 246.

Associated with processor 320 is a memory for storing operating and application programs, and other computer programs and/or data needed for operating processor 320. Also associated with processor 320 is a relational database 360 in which is stored database records containing data received from PEMDS 100 and protective headgear 10 substantially in real time. However, where PEMD data is relayed via a command center 228, 246 that monitors and responds to such PEMD data substantially in real time when warranted, PEMD data may be but need not be forwarded to central facility 310 substantially in real time, but may be forwarded from time to time.

As described, PEMD data includes location data and motion data that is associated with the unique identifier of the PEMD 100 that produces and transmits such data. Database 360 (or memory 350) also includes GPS coordinates for site 200 and for each area, e.g., areas 220, 230, 240, 242, and object, e.g., fences 210, 230, gates 212, 214, equipment 222, 224, 226, 228, 232, 244, 246, therein as well as GPS coordinates for each PEMD 100 that define the areas, objects and equipment that the PEMD 100 (by its unique identifier) is permitted and/or not permitted to be in or at. It is noted that defining permitted areas, objects and equipment may be sufficient to define by exclusion the areas that are not permitted, and vice versa, although both may be defined, as may unrestricted areas, objects and equipment.

As PEMD data is received the location data therein is related by its unique identifier data and thereby compared against the stored GPS coordinates for its permitted and/or not permitted areas, objects and equipment substantially in real time, and when presence in a non-permitted area or at a non-permitted object or equipment is identified or absence from a permitted area, object or equipment is identified, notification thereof is generated and is transmitted directly or indirectly to the PEMD 100 having that unique identifier substantially in real time, and is preferably also transmitted to a management notification for monitoring and or further action as may be appropriate.

As PEMD data is received the motion data therein is related by its unique identifier data and thereby compared against stored criteria for allowable periods of lack of movement, e.g., which may typically be in the range of about five to thirty seconds, and which may vary depending upon the nature of the danger or hazard associated with the particular area, object or equipment in or at which the PEMD 100 is then present. When lack of movement for a period exceeding the predetermined threshold is identified, notification thereof is generated and is transmitted directly or indirectly to the PEMD 100 having that unique identifier substantially in real time, and preferably is also transmitted to a management notification for monitoring and or further action as may be appropriate.

Where PEMD 100 is employed in association with a personal ID badge 400, data therefrom including its unique identifier is associated with the unique identifier of that person's PEMD 100 and are stored in relational database 360, whereby the comparisons and the data and notifications generated thereby are associated with a particular person and the particular PEMD 100 of protective headgear 10 used by that person, whereby more complete and useful notifications can be provided.

Figure 8:
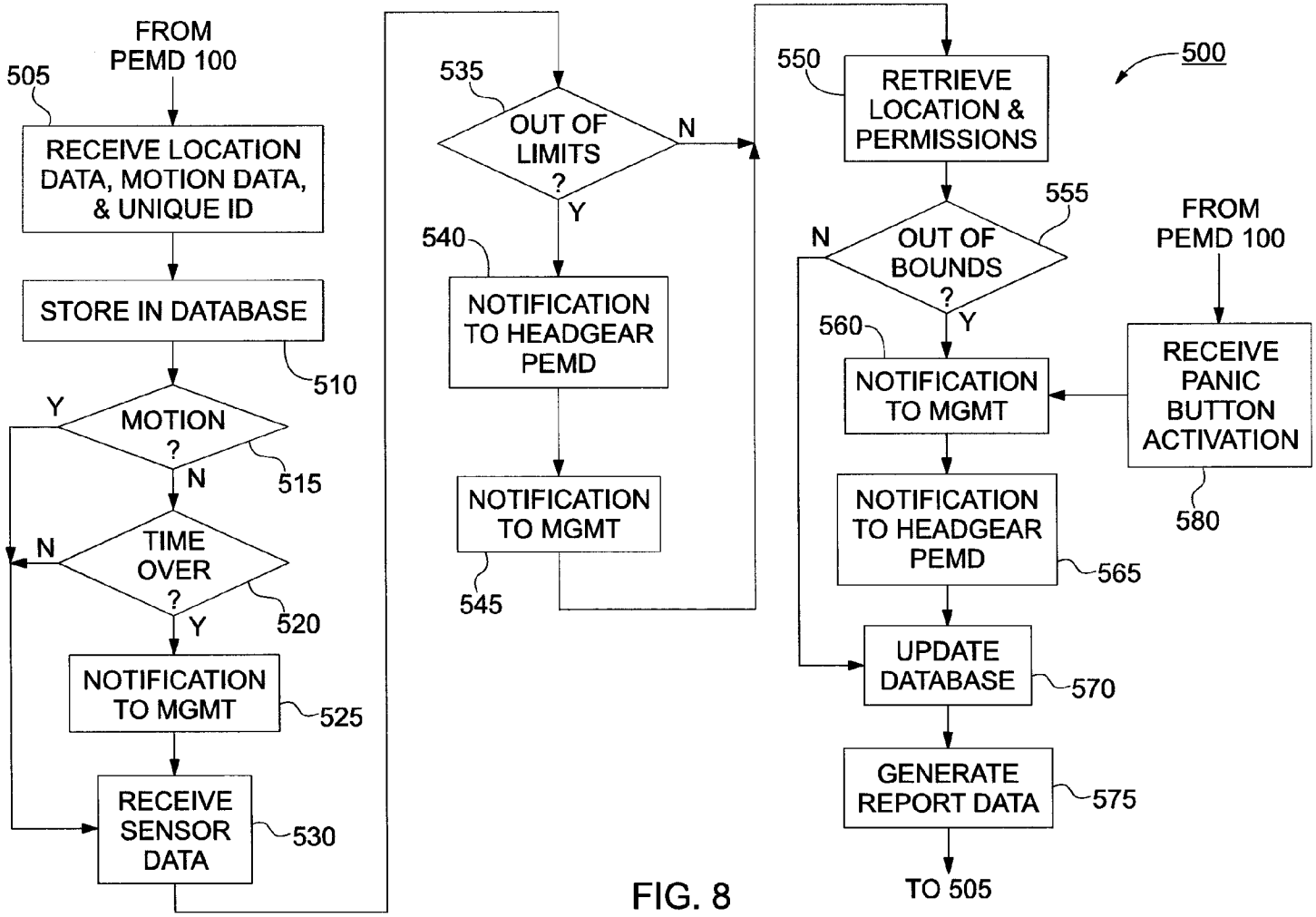
FIG. 8 is a schematic diagram illustrating an example embodiment of the operation of the example monitoring station of FIG. 7 with the example devices of FIGS. 1-6.

FIG. 8 is a schematic diagram illustrating an example embodiment of the operation 500 of the example monitoring station 310 of FIG. 7 with the example PEMD devices 100 of FIGS. 1-6. Operation or process 500 begins with receiving 505 location data, motion sensor data and a unique identifier from a PEMD 100 and storing 510 that record in a relational database. Preferably, all data associated with the foregoing data, e.g., date-time stamps, other sensor data and the like, is all stored in the same data base record or in separate database records that are related by the PEMD unique identifier, location and date-time stamp.

While the order in which the comparison or testing steps 515-565 now to be described are performed is not especially important because the entirety of process 500 is preferably completed in one or two seconds or less, they are illustrated in an example order that tests personnel condition (animation) first, dangerous and/or hazardous conditions next, and then tests personnel location relative to permitted and prohibited locations (permissions).

Motion testing, e.g., for personnel animation, first tests 515 the motion data for whether or not movement has been detected. If motion is detected, 515-Y, then the personnel is animated and presumed normal and path 515-Y leads directly to step 530. If no movement is detected, 515-N, then using related database records the time during which no movement has been detected is tested 520. If the no movement time exceeds 520-Y a predetermined threshold above which it is presumed that there is no animation of that personnel, then 520-Y a notification to management is generated 525 so that appropriate investigation and/or assistance can be provided. If the no-movement time is less 520-N than the predetermined threshold, then 520-N process 500 proceeds directly to step 530.

Sensor data, e.g., from other sensors 166, 168 is retrieved 530 from the relational database and each item of data is tested 535 against normal and/or acceptable predetermined threshold levels or limits, e.g., based upon predetermined safety and/or exposure standards, for whether or not it is out of bounds 535. If the sensor data is within the predetermined limits, then path 535-N takes process 500 directly to step 550. If the sensor data is not within the predetermined levels, i.e. is out of limits, then 535-Y path is followed to generate 540 a notification to the PEMD 100 of headgear 10 of that personnel or if the condition is such as to threaten some or all personnel, notification is sent 540 to the PEMDS 100 of the some or all personnel. Notification 540 to personnel can take the form of a cease operation, take prescribed action, seek shelter, evacuate, and the like. A like notification is generated 545 for management for their oversight, ordering an appropriate response, and/or providing further notifications outside of the site.

Location permissions, e.g., the GPS coordinates and times designating the areas that a particular personnel is permitted to be in and designating the areas and times for areas for which that personnel is not to be in are retrieved 550 from the relational data base, again using the unique identifier of that personnel's PEMD 100 and/or personnel ID badge 400. The retrieved 550 location data for that personnel is compared 555 with (or tested 550 against) the permissions retrieved 550 from the database. If the personnel is where he is permitted to be, e.g., in bounds or not out of bounds, then path 555-N takes process 500 directly to step 570. If the personnel is where he is not permitted to be, e.g., is out of bounds, then path 555-Y leads to generating 560 notifications to management so that appropriate investigation and/or action can be initiated, and generating 565 a notification to the PEMD 100 of the headgear 10 of that personnel so that the personnel can move promptly out of a prohibited area and into to a permitted location.

It is noted that presence in an area causing an out of bounds result 555-Y may only be an error, but it could also be an indication that a security or other serious action is being attempted, which the notification thereof serves to advise management and/or security personnel that investigation may be advisable.

Further, the comparing 555 of personnel location and personnel location permissions may be utilized for granting and/or denying access to certain areas and/or equipment to which access is controlled, e.g., for providing access control based upon the unique identifier of PEMD 100 and/or the unique badge identifier of badge 400. While personnel location permissions may be stored in a central database, e.g., a database 360 at a monitoring station 310 and/or at a command center 228, 246, and access control may be performed by communication with that central database via transmitter-receiver 170, access control may be otherwise provided. For example, an access control device may be provided proximate the gate, area and/or equipment to which access is to be controlled wherein the access control device has some or all of the personnel location permissions stored therein and has a receiver and transmitter for communicating with PEMD 100 and/or personnel badge 400, e.g., via transmitter-receiver 170 and/or 470 thereof.

Then, preferably after the data is received and comparisons made, the relational database 360 is updated 570 to store records of the results of comparisons 515, 520, 535, 555, and/or of all notifications generated 525, 540, 545, 560, 565. The stored 570 updated records may include all or some of the results, e.g., only the out of limits comparisons and notifications generated in response thereto, as may be appropriate and desirable in any given circumstance. The updated 570 database records may be accumulated for generating 575 reports for site and/or overall management, for security, for environmental monitoring, for safety monitoring, for compliance monitoring, and/or for other monitoring and management purposes.

Where exposure time to a particular danger or hazard is important, the reports generated 575 can include cumulative exposure time based upon the location data to indicate proximity to the danger or hazard as derived from location data and date-time stamps thereof stored in the records of the relational database combined with detected levels of exposure as represented in the sensor data for that particular hazard transmitted from PEMD 100 and stored in the relational database, all related to each other by the unique identifier of a PEMD 100 and/or the unique badge identifier of a personnel ID badge 400.

Activation of a Help-on-Demand 140 or panic button 140 of a PEMD 100 causes device 100 to communicate an out of limits condition to the monitoring station which could be a separately defined transmission code or a combination of out of limits conditions that the relational database detects as a call for help or assistance. By way of example, such transmission could be received 580 from PEMD 100 and immediately initiate notifications 560 to management and notifications 565 to PEMD 100 devices in close proximity, e.g., as determined from the most recent location data received 505 from that particular PEMD 100, and all related by the unique identifier of that particular PEMD 100. The result is that any available help and/or assistance, whether from nearby personnel identified by their location data or from command center and/or monitoring station and/or other centralized or specialized resources, e.g., security and/or rescue staff personnel, may be quickly dispatched.

The notifications responsive to the panic button activation are preferably augmented by data visually and/or audibly presented on the user interfaces 120, 130 of PEMD 100 devices to the PEMD 100 whose panic button 140 was activated, as determined, e.g., from the location data thereof. Date-time stamps and other data relating to the panic button activation, to the notifications, to the response commands and actions, and of location and other data of the PEMDS 100 of other personnel will be available for analysis of the emergent condition and of the response thereto, all by records in the database that are relatable using the unique identifiers and/or location data and/or other data from any number of PEMDS 100.

Protective headgear 10, 100 for use in dangerous and/or hazardous locations may comprise: a headgear shell 12 configured to be worn on a human head; a locator device 162 supported on the headgear shell 12 for providing location data representative of the location thereof; a motion sensor 164 supported on the headgear shell 12 for providing motion data representing movement thereof; a memory 152 supported on the headgear shell 12 and having a unique identifier stored therein, wherein the memory 152 is configured to store the location data provided by the locator device 162 and motion data provided by the motion sensor 164; an antenna 180 supported on the headgear shell 12; a transmitter-receiver 170 coupled to the antenna 180 for transmitting the location data, the motion data and the unique identifier to a remote database and for receiving notification data from the remote database which is responsive to the location data and the motion data; and a user interface 120, 130 supported on the headgear shell 12 responsive to the received notification data to provide a visual notification or an audible notification or a physical notification or a combination thereof. The locator device 162 may include: a global positioning system receiver 162; or a global positioning system receiver 162 including wide area augmentation; or an accelerometer 160, 162, 164; or a global positioning system receiver 162 and an accelerometer 160, 162, 164. The protective headgear 10, 100 may further comprise at least one accelerometer and/or a gyroscopic device 160, 162, 164 and/or a received signal strength indication device 160, 166 configured to provide motion data and to provide location data relative to a location determined by the global positioning system receiver 162, whereby location data is provided when GPS signal to the global positioning system receiver 162 is lost. The motion sensor 164 may be configured to provide motion data that is representative of whether a person wearing the protective headgear 10, 100 is animated or is substantially motionless. A notification may be transmitted by the transmitter-receiver 170 when the motion data represents that the person wearing the protective headgear 10, 100 is substantially motionless for more than a predetermined period of time. The motion sensor 164 may include at least one accelerometer. The protective headgear 10, 100 in combination with a personnel identification badge 400 that may comprise: a memory 452 having a unique badge identifier stored therein; and a transmitter 470 for transmitting the stored unique badge identifier at least to the transmitter-receiver 170 of the protective headgear 10, 100; wherein the unique badge identifier is associated with at least the unique identifier of the protective headgear 10, 100. The transmitter 470 of the personnel identification badge 400 and the transmitter-receiver 170 of the protective headgear 10, 100 communicate wirelessly using an RFID or Bluetooth communication protocol. The protective headgear 10, 100 may further comprise a processor 150, wherein the processor 150 is coupled between the locator device 162, the motion sensor 164, the memory 152 and the transmitter-receiver 170. The protective headgear 10, 100 may further comprise one or more other sensors 160, 166, 168 that monitor health-indicating characteristics of personnel, ambient conditions, hazardous substances, hazardous conditions, and/or the environment. The other sensors 160, 166, 168 may include sensors of environmental conditions, temperature, pressure, position, acceleration, impact, distance, gyroscopic and/or inertial information, magnetic field, electrical continuity, altitude, a physical parameter, moisture, humidity, chemicals, gases, medical parameters, biological substances and/or agents, radioactivity, optical, light, infrared, images, still and/or video images, sound, noise, electromagnetic fields, and any combination of any two or more thereof. A notification may be: transmitted by the transmitter-receiver 170 when one of the other sensors 160, 166, 168 detects a dangerous or hazardous environmental condition, temperature, acceleration, impact, physical parameter, chemical, gas, medical parameter, biological substance and/or agent, radioactivity, or any combination thereof, and when a panic button 140 is activated; or provided by the user interface 120, 130 when one of the other sensors 160, 166, 168 detects a dangerous or hazardous environmental condition, temperature, acceleration, impact, physical parameter, chemical, gas, medical parameter, biological substance and/or agent, radioactivity, or any combination thereof; or transmitted by the transmitter-receiver 170 and provided by the user interface 120, 130 when one of the other sensors 160, 166, 168 detects a dangerous or hazardous environmental condition, temperature, acceleration, impact, physical parameter, chemical, gas, medical parameter, biological substance and/or agent, radioactivity, or any combination thereof, and when a panic button 140 is activated. The protective headgear 10, 100 may further comprise a further sensor 168 including a radar, a Doppler radar, an ultrasonic sensor, an optical distance measuring sensor, an optical object sensing device, a laser distance measuring sensor, a laser object sensing device, an imager, a still imager, a video imager, a two dimensional imager, a three dimensional imager, a directional microphone, or a combination thereof, supported on the headgear shell 12. Data from the further sensor 168 may be: stored in the memory 152, or coupled to the transmitter-receiver 170 for transmission, or stored in the memory 152 and coupled to the transmitter-receiver 170 for transmission. The user interface 120, 130 may comprise: a sound transducer 130 including any one or more of a buzzer, beeper, annunciator, loudspeaker, earphone, an audibly perceptible device, a microphone, a sound pick up device, or any combination thereof; or a visual transducer 120 including any one or more of a light, a flashing light, a light producing different colors, a LED, a LCD display, a visually perceptible device, a display screen, an imaging device to capture still and/or video images, or a combination thereof; or both a sound transducer 130 and a visual transducer 120. The user interface 120, 130 may include any one or more of an annunciator, loudspeaker, earphone, or an audibly perceptible device, and may include a microphone, or a sound pick up device, coupled to the transmitter-receiver 170 for providing two-way voice communication. The unique identifier stored in the memory 152 or a unique badge identifier stored in a personnel identification badge 400, or both, may be compared with the location data and with personnel location permissions for granting and/or denying access to certain areas and/or equipment to which access is controlled.

Protective headgear 10, 100 for use in dangerous and/or hazardous locations may comprise: a headgear shell 12 configured to be worn on a human head; a locator device 162 supported on the headgear shell 12 for providing location data representative of the location thereof; a memory 152 supported on the headgear shell 12 and having a unique identifier stored therein, wherein the memory 152 is configured to store the location data provided by the locator device 162; an antenna 180 supported on the headgear shell 12; a transmitter-receiver 170 coupled to the antenna 180 for transmitting the location data and the unique identifier to a remote database and for receiving notification data from the remote database which is responsive to the location data; and a user interface 120, 130 supported on the headgear shell 12 responsive to the received notification data to provide a visual notification or an audible notification or a physical notification or a combination thereof. The locator device 162 may include: a global positioning system receiver 162; or a global positioning system 162 receiver including wide area augmentation; or an accelerometer 160, 162, 164; or a global positioning system 162 receiver and an accelerometer 160, 162, 164. The protective headgear 10, 100 may further comprise at least one accelerometer and/or gyroscopic device 160, 162, 164 and/or a received signal strength indication device 160, 166 configured to provide motion data and to provide location data relative to a location determined by the global positioning system receiver 162, whereby location data is provided when GPS signal to the global positioning system receiver 162 is lost. The protective headgear 10, 100 may further comprise a motion sensor 164, wherein the motion sensor 164 is configured to provide motion data that is representative of whether a person wearing the protective headgear 10, 100 is animated or is substantially motionless. A notification may be transmitted by the transmitter-receiver 170 when the motion data represents that the person wearing the protective headgear 10, 100 is substantially motionless for more than a predetermined period of time. The protective headgear 10, 100 may further comprise a motion sensor 164, wherein the motion sensor 164 may include at least one accelerometer. The protective headgear 10, 100 in combination with a personnel identification badge 400 that may comprise: a memory 452 having a unique badge identifier stored therein; and a transmitter 470 for transmitting the stored unique badge identifier at least to the transmitter-receiver 170 of the protective headgear 10, 100; wherein the unique badge identifier is associated with at least the unique identifier of the protective headgear 10, 100. The transmitter 470 of the personnel identification badge 400 and the transmitter-receiver 170 of the protective headgear 10, 100 communicate wirelessly using an RFID or Bluetooth communication protocol. The protective headgear 10, 100 may further comprise a processor 150, wherein the processor 150 is coupled between the locator device 162, the motion sensor 164, the memory 152 and the transmitter-receiver 170. The protective headgear 10, 100 may further comprise one or more other sensors 160, 166, 168 that monitor health-indicating characteristics of personnel, ambient conditions, hazardous substances, hazardous conditions, and/or the environment. The other sensors 160, 166, 168 may include sensors of environmental conditions, temperature, pressure, position, acceleration, impact, distance, gyroscopic and/or inertial information, magnetic field, electrical continuity, altitude, a physical parameter, moisture, humidity, chemicals, gases, medical parameters, biological substances and/or agents, radioactivity, optical, light, infrared, images, still and/or video images, sound, noise, electromagnetic fields, and any combination of any two or more thereof. A notification may be: transmitted by the transmitter-receiver 170 when one of the other sensors 160, 166, 168 detects a dangerous or hazardous environmental condition, temperature, acceleration, impact, physical parameter, chemical, gas, medical parameter, biological substance and/or agent, radioactivity, or any combination thereof, and when a panic button 140 is activated; or provided by the user interface 120, 130 when one of the other sensors 160, 166, 168 detects a dangerous or hazardous environmental condition, temperature, acceleration, impact, physical parameter, chemical, gas, medical parameter, biological substance and/or agent, radioactivity, or any combination thereof; or transmitted by the transmitter-receiver 170 and provided by the user interface 120, 130 when one of the other sensors 160, 166, 168 detects a dangerous or hazardous environmental condition, temperature, acceleration, impact, physical parameter, chemical, gas, medical parameter, biological substance and/or agent, radioactivity, or any combination thereof, and when a panic button 140 is activated. The protective headgear 10, 100 may further comprise a further sensor 168 including a radar, a Doppler radar, an ultrasonic sensor, an optical distance measuring sensor, an optical object sensing device, a laser distance measuring sensor, a laser object sensing device, an imager, a still imager, a video imager, a two dimensional imager, a three dimensional imager, a directional microphone, or a combination thereof, supported on the headgear shell 12. Data from the further sensor 168 may be: stored in the memory 152, or coupled to the transmitter-receiver 170 for transmission, or stored in the memory 152 and is coupled to the transmitter-receiver 170 for transmission. The user interface 120, 130 comprises: a sound transducer 13 including any one or more of a buzzer, beeper, annunciator, loudspeaker, earphone, an audibly perceptible device, a microphone, a sound pick up device, or any combination thereof; or a visual transducer 120 including any one or more of a light, a flashing light, a light producing different colors, a LED, a LCD display, a visually perceptible device, a display screen, an imaging device to capture still and/or video images, or a combination thereof; or both a sound transducer 130 and a visual transducer 120. The user interface 120, 130 may include any one or more of an annunciator, loudspeaker, earphone, or an audibly perceptible device, and may include a microphone, or a sound pick up device, coupled to the transmitter-receiver 170 for providing two-way voice communication. The unique identifier stored in the memory 152 or a unique badge identifier stored in a personnel identification badge 400, or both, may be compared with the location data and with personnel location permissions for granting and/or denying access to certain areas and/or equipment to which access is controlled.

Protective headgear 10, 100 for use in dangerous and/or hazardous locations may comprise: a headgear shell 12 configured to be worn on a human head; a locator device 162 supported on the headgear shell 12 for providing location data representative of the location thereof; a motion sensor 164 supported on the headgear shell 12 for providing motion data representing movement thereof; a memory 152 supported on the headgear shell 12 and having a unique identifier stored therein, wherein the memory 152 is configured to store the location data provided by the locator device 162 and motion data provided by the motion sensor 164; an antenna 180 supported on the headgear shell 12; a transmitter-receiver 170 coupled to the antenna 180 for transmitting the location data, the motion data and the unique identifier to a remote database. The transmitter-receiver 170 may receive notification data from the remote database which is responsive to the location data and the motion data; and a user interface 120, 130 supported on the headgear shell 12 responsive to the received notification data to provide a visual notification or an audible notification or a physical notification or a combination thereof. The locator device 162 may include: a global positioning system receiver 162; or a global positioning system 162 receiver including wide area augmentation; or an accelerometer 160, 162, 164; or a global positioning system receiver 162 and an accelerometer 160, 162, 164. The protective headgear 10, 100 may further comprise at least one accelerometer and/or gyroscopic device 160, 162, 164 and/or a received signal strength indication device 160, 166 configured to provide motion data and to provide location data relative to a location determined by the global positioning system receiver 162, whereby location data is provided when GPS signal to the global positioning system receiver 162 is lost. The motion sensor 164 may be configured to provide motion data that is representative of whether a person wearing the protective headgear 10, 100 is animated or is substantially motionless. A notification may be transmitted by the transmitter-receiver 170 when the motion data represents that the person wearing the protective headgear 10, 100 is substantially motionless for more than a predetermined period of time. The motion sensor 164 may include at least one accelerometer. The protective headgear 10, 100 in combination with a personnel identification badge 400 that may comprise: a memory 452 having a unique badge identifier stored therein; and a transmitter for transmitting the stored unique badge identifier at least to the transmitter-receiver of the protective headgear 10, 100; wherein the unique badge identifier is associated with at least the unique identifier of the protective headgear 10, 100. The transmitter 470 of the personnel identification badge 400 and the transmitter-receiver 170 of the protective headgear 10, 100 may communicate wirelessly using an RFID or Bluetooth communication protocol. The protective headgear 10, 100 may further comprise a processor 150, wherein the processor 150 is coupled between the locator device 162, the motion sensor 164, the memory 152 and the transmitter-receiver 170. The protective headgear 10, 100 may further comprise one or more other sensors 160, 166, 168 that monitor health-indicating characteristics of personnel, ambient conditions, hazardous substances, hazardous conditions, and/or the environment. The other sensors 160, 166, 168 may include sensors of environmental conditions, temperature, pressure, position, acceleration, impact, distance, gyroscopic and/or inertial information, magnetic field, electrical continuity, altitude, a physical parameter, moisture, humidity, chemicals, gases, medical parameters, biological substances and/or agents, radioactivity, optical, light, infrared, images, still and/or video images, sound, noise, electromagnetic fields, and any combination of any two or more thereof. A notification may be: transmitted by the transmitter-receiver 170 when one of the other sensors 160, 166, 168 detects a dangerous or hazardous environmental condition, temperature, acceleration, impact, physical parameter, chemical, gas, medical parameter, biological substance and/or agent, radioactivity, or any combination thereof, and when a panic button 140 is activated; or provided by the user interface 120, 130 when one of the other sensors 160, 166, 168 detects a dangerous or hazardous environmental condition, temperature, acceleration, impact, physical parameter, chemical, gas, medical parameter, biological substance and/or agent, radioactivity, or any combination thereof; or transmitted by the transmitter-receiver 170 and provided by the user interface 120, 130 when one of the other sensors 160, 166, 168 detects a dangerous or hazardous environmental condition, temperature, acceleration, impact, physical parameter, chemical, gas, medical parameter, biological substance and/or agent, radioactivity, or any combination thereof, and when a panic button 140 is activated. The protective headgear 10, 100 may further comprise a further sensor 168 including a radar, a Doppler radar, an ultrasonic sensor, an optical distance measuring sensor, an optical object sensing device, a laser distance measuring sensor, a laser object sensing device, an imager, a still imager, a video imager, a two dimensional imager, a three dimensional imager, a directional microphone, or a combination thereof, supported on the headgear shell 12. Data from the further sensor 168 may be: stored in the memory 152, or coupled to the transmitter-receiver 170 for transmission, or stored in the memory 152 and is coupled to the transmitter-receiver 170 for transmission. The e user interface 120, 130 may comprise: a sound transducer 130 including any one or more of a buzzer, beeper, annunciator, loudspeaker, earphone, an audibly perceptible device, a microphone, a sound pick up device, or any combination thereof; or a visual transducer 120 including any one or more of a light, a flashing light, a light producing different colors, a LED, a LCD display, a visually perceptible device, a display screen, an imaging device to capture still and/or video images, or a combination thereof; or both a sound transducer 130 and a visual transducer 120. The user interface 120, 130 may include any one or more of an annunciator, loudspeaker, earphone, or an audibly perceptible device, and may include a microphone, or a sound pick up device, coupled to the transmitter-receiver 170 for providing two-way voice communication. The unique identifier stored in the memory 152 or a unique badge identifier stored in a personnel identification badge 400, or both, may be compared with the location data and with personnel location permissions for granting and/or denying access to certain areas and/or equipment to which access is controlled.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Although terms such as "up," "down," "left," "right," "up," "down," "front," "rear," "side," "end," "top," "bottom," "forward," "backward," "under" and/or "over," "vertical," "horizontal," and the like may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed.

As used herein, the term "and/or" encompasses both the conjunctive and the disjunctive cases, so that a phrase in the form "A and/or B" encompasses "A" or "B" or "A and B." In addition, the term "at least one of" one or more elements is intended to include one of any one of the elements, more than one of any of the elements, and two or more of the elements up to and including all of the elements, and so, e.g., the phrase in the form "at least one of A, B and C" includes "A," "B," "C," "A and B," "A and C," "B and C," and "A and B and C."

A fastener as used herein may include any fastener or other fastening device that may be suitable for the described use, including threaded fasteners, e.g., bolts, screws and driven fasteners, as well as pins, rivets, nails, spikes, barbed fasteners, clips, clamps, nuts, speed nuts, cap nuts, acorn nuts, and the like. Where it is apparent that a fastener would be removable in the usual use of the example embodiment described herein, then removable fasteners would be preferred in such instances. A fastener may also include, where appropriate, other forms of fastening such as a formed head, e.g., a peened or heat formed head, a weld, e.g., a heat weld or ultrasonic weld, a braze, and adhesive, and the like.

While various operations, steps and/or elements of a process or method or operation may be described in an order or sequence, the operations, steps and/or elements do not need to be performed in that order or sequence, or in any particular order or sequence, unless expressly stated to require a particular order or sequence.

As used herein, the terms "connected" and "coupled" as well as variations thereof are not intended to be exact synonyms, but to encompass some similar things and some different things. The term "connected" may be used generally to refer to elements that have a direct electrical and/or physical contact to each other, whereas the term "coupled" may be used generally to refer to elements that have an indirect electrical and/or physical contact with each other, e.g., via one or more intermediate elements, so as to cooperate and/or interact with each other, and may include elements in direct contact as well.

It is noted that various data, sensor values and alarm values may represent actual physical conditions of different places and/or different equipment and/or different parts of an installation, equipment and/or other place, e.g., generally local conditions, that may be transformed by the system and method described herein to provide a representation of the overall state and/or condition of the installation, equipment and/or place, e.g. a representation of the complete installation, equipment and/or place. That representation may be transformative of a representation of a nominal overall state and/or condition thereof, e.g., in a prior or different condition and/or time, to a representation of an actual overall state and/or condition thereof, e.g., in a present or more recent or otherwise different condition and/or time. Further, the system and method may generate tasks and commands that are executed to transform the installation, equipment and/or place into a different configuration, i.e. into a different installation, equipment and/or place, and a representation of that different configuration is provided or displayed, e.g., to human operators. The system described herein may include one or more general purpose and/or special purpose computers, or microprocessors or other processors, and the method described herein may be performed in part by one or more general purpose and/or special purpose computers, or microprocessors or other processors.

As used herein, image and/or information are used interchangeably with respect to what is captured by an imaging device and/or is displayed on a display device, and are intended to encompass any and all of the wide variety of devices that a user may desire, including, but not limited to, visual images and pictures, whether still or moving, whether captured and/or generated by a camera, computer or any other source, whether true, representative or abstract or arbitrary, whether or not including symbols or characters such as alphanumeric characters or mathematical notations, whether captured and/or displayed in black and white, monochrome, polychrome or full color.

While the present invention has been described in terms of the foregoing example embodiments, variations within the scope and spirit of the present invention as defined by the claims following will be apparent to those skilled in the art. For example, PEMD 100 can be mounted inside of protective headgear 10, at least where shell 12 thereof is not electrically conductive which could adversely affect wireless communication.

While Help-on-Demand or panic button 240 is illustrated as being part of PEMD 100, it may be provided as a separate piece to be mounted at a suitable and convenient location on headgear shell 12, e.g., by a hook and loop fastener or by a pressure sensitive or other adhesive, and be coupled to PEMD 100 via wires or a wireless link, e.g., a Bluetooth link.

While any single suitable communication link between PEMDS 100 and communication relays 250, and between communication relays 250 and a central facility 228, 246, 290, may be sufficient, redundant communication links, e.g., WiFi and an RF link, e.g., at 433 MHz, may be employed, and in certain environments may be desirable.

Protective headgear 10 may include a hard hat, helmet, enclosed helmet, part of a protective suit, e.g., a biological-hazard, radiation-hazard, or chemical-hazard suit, or other protective clothing and/or covering, or any other headgear with which a personnel electronic monitor device (PEMD) is or may be used.

Each of the U.S. Provisional Applications, U.S. patent applications, and/or U.S. patents, identified herein is hereby incorporated herein by reference in its entirety, for any purpose and for all purposes irrespective of how it may be referred to or described herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. Protective headgear for use in dangerous and/or hazardous locations comprising:

a headgear shell configured to be worn on a human head;

a locator device supported on said headgear shell for providing location data representative of the location thereof;

a motion sensor supported on said headgear shell for providing motion data representing movement thereof;

an imaging device supported on said headgear shell for providing image data representing a scene proximate said headgear;

a memory supported on said headgear shell and having a unique identifier stored therein, wherein said memory is configured to store the location data provided by said locator device, motion data provided by said motion sensor and image data provided by said imaging device;

an antenna supported on said headgear shell;

a transmitter-receiver coupled to said antenna for transmitting the location data, the motion data, the image data and the unique identifier to a remote database and for receiving notification data from the remote database which is responsive to the location data and the motion data; and a user interface supported on said headgear shell responsive to the received notification data to provide a visual notification or an audible notification or a physical notification or a combination thereof.

2. The protective headgear of claim 1 wherein said locator device includes:

a global positioning system receiver; or a global positioning system receiver including wide area augmentation.

3. The protective headgear of claim 2 further comprising at least one accelerometer and/or gyroscopic device and/or a received signal strength indication device configured to provide motion data and to provide location data relative to a location determined by said global positioning system receiver, whereby location data is provided when GPS signal to said global positioning system receiver is lost.

4. The protective headgear of claim 1 wherein said motion sensor is configured to provide motion data that is representative of whether a person wearing said protective headgear is animated or is substantially motionless.

5. The protective headgear of claim 4 wherein a notification is transmitted by said transmitter-receiver when the motion data represents that the person wearing said protective headgear is substantially motionless for more than a predetermined period of time.

6. The protective headgear of claim 1 wherein said motion sensor includes at least one accelerometer.

7. The protective headgear of claim 1 in combination with a personnel identification badge comprising:

a memory having a unique badge identifier stored therein; and a transmitter for transmitting the stored unique badge identifier at least to said transmitter-receiver of said protective headgear;

wherein the unique badge identifier is associated with at least the unique identifier of said protective headgear.

8. The protective headgear of claim 7 wherein the transmitter of said personnel identification badge and the transmitter-receiver of said protective headgear communicate wirelessly using an RFID or Bluetooth communication protocol.

9. The protective headgear of claim 1 further comprising a processor, wherein said processor is coupled between said locator device, said motion sensor, said memory and said transmitter-receiver.

10. The protective headgear of claim 1 further comprising one or more other sensors that monitor health-indicating characteristics of personnel, ambient conditions, hazardous substances, hazardous conditions, and/or the environment.

11. The protective headgear of claim 10 wherein said other sensors include sensors of environmental conditions, temperature, pressure, position, acceleration, impact, distance, gyroscopic and/or inertial information, magnetic field, electrical continuity, altitude, a physical parameter, moisture, humidity, chemicals, gases, medical parameters, biological substances and/or agents, radioactivity, optical, light, infrared, images, still and/or video images, sound, noise, electromagnetic fields, and any combination of any two or more thereof.

12. The protective headgear of claim 10 wherein a notification is:

transmitted by said transmitter-receiver when one of said other sensors detects a dangerous or hazardous environmental condition, temperature, acceleration, impact, physical parameter, chemical, gas, medical parameter, biological substance and/or agent, radioactivity, or any combination thereof, and when a panic button is activated; or provided by said user interface when one of said other sensors detects a dangerous or hazardous environmental condition, temperature, acceleration, impact, physical parameter, chemical, gas, medical parameter, biological substance and/or agent, radioactivity, or any combination thereof; or transmitted by said transmitter-receiver and provided by said user interface when one of said other sensors detects a dangerous or hazardous environmental condition, temperature, acceleration, impact, physical parameter, chemical, gas, medical parameter, biological substance and/or agent, radioactivity, or any combination thereof, and when a panic button is activated.

13. The protective headgear of claim 1 wherein said imaging device includes a still imager, a video imager, a two dimensional imager and/or a three dimensional imager, and further comprising a further sensor including a radar, a Doppler radar, an ultrasonic sensor, an optical distance measuring sensor, an optical object sensing device, a laser distance measuring sensor, a laser object sensing device, a directional microphone, or a combination thereof, supported on said headgear shell.

14. The protective headgear of claim 13 wherein data from said further sensor:

is stored in said memory, or is coupled to said transmitter-receiver for transmission, or is stored in said memory and is coupled to said transmitter-receiver for transmission.

15. The protective headgear of claim 1 wherein said user interface comprises:

a sound transducer including any one or more of a buzzer, beeper, annunciator, loudspeaker, earphone, an audibly perceptible device, a microphone, a sound pick up device, or any combination thereof; or a visual transducer including any one or more of a light, a flashing light, a light producing different colors, a LED, a LCD display, a visually perceptible device, a display screen, an imaging device to capture still and/or video images, or a combination thereof; or both the sound transducer and the visual transducer.

16. The protective headgear of claim 1 wherein said user interface includes any one or more of an annunciator, loudspeaker, earphone, or an audibly perceptible device, and includes a microphone, or a sound pick up device, coupled to said transmitter-receiver for providing two-way voice communication.

17. The protective headgear of claim 1 wherein the unique identifier stored in said memory or a unique badge identifier stored in a personnel identification badge, or both, are compared with the location data and with personnel location permissions for granting and/or denying access to certain areas and/or equipment to which access is controlled.

18. Protective headgear for use in dangerous and/or hazardous locations comprising:

a headgear shell configured to be worn on a human head;

a locator device supported on said headgear shell for providing location data representative of the location thereof;

an imaging device supported on said headgear shell for providing image data representing a scene proximate said headgear;

a memory supported on said headgear shell and having a unique identifier stored therein, wherein said memory is configured to store the location data provided by said locator device and the image data provided by said imaging device;

an antenna supported on said headgear shell;

a transmitter-receiver coupled to said antenna for transmitting the location data, the image data and the unique identifier to a remote database and for receiving notification data from the remote database which is responsive to the location data; and a user interface supported on said headgear shell responsive to the received notification data to provide a visual notification or an audible notification or a physical notification or a combination thereof.

19. The protective headgear of claim 18 wherein said locator device includes:

a global positioning system receiver; or a global positioning system receiver including wide area augmentation.

20. The protective headgear of claim 19 further comprising at least one accelerometer and/or gyroscopic device and/or a received signal strength indication device configured to provide motion data and to provide location data relative to a location determined by said global positioning system receiver, whereby location data is provided when GPS signal to said global positioning system receiver is lost.

21. The protective headgear of claim 18 further comprising a motion sensor, wherein said motion sensor is configured to provide motion data that is representative of whether a person wearing said protective headgear is animated or is substantially motionless.

22. The protective headgear of claim 21 wherein a notification is transmitted by said transmitter-receiver when the motion data represents that the person wearing said protective headgear is substantially motionless for more than a predetermined period of time.

23. The protective headgear of claim 18 further comprising a motion sensor, wherein said motion sensor includes at least one accelerometer.

24. The protective headgear of claim 18 in combination with a personnel identification badge comprising:

a memory having a unique badge identifier stored therein; and a transmitter for transmitting the stored unique badge identifier at least to said transmitter-receiver of said protective headgear;

wherein the unique badge identifier is associated with at least the unique identifier of said protective headgear.

25. The protective headgear of claim 24 wherein the transmitter of said personnel identification badge and the transmitter-receiver of said protective headgear communicate wirelessly using an RFID or Bluetooth communication protocol.

26. The protective headgear of claim 18 further comprising a processor, wherein said processor is coupled between said locator device, said motion sensor, said memory and said transmitter-receiver.

27. The protective headgear of claim 18 further comprising one or more other sensors that monitor health-indicating characteristics of personnel, ambient conditions, hazardous substances, hazardous conditions, and/or the environment.

28. The protective headgear of claim 27 wherein said other sensors include sensors of environmental conditions, temperature, pressure, position, acceleration, impact, distance, gyroscopic and/or inertial information, magnetic field, electrical continuity, altitude, a physical parameter, moisture, humidity, chemicals, gases, medical parameters, biological substances and/or agents, radioactivity, optical, light, infrared, images, still and/or video images, sound, noise, electromagnetic fields, and any combination of any two or more thereof.

29. The protective headgear of claim 27 wherein a notification is:

transmitted by said transmitter-receiver when one of said other sensors detects a dangerous or hazardous environmental condition, temperature, acceleration, impact, physical parameter, chemical, gas, medical parameter, biological substance and/or agent, radioactivity, or any combination thereof, and when a panic button is activated; or provided by said user interface when one of said other sensors detects a dangerous or hazardous environmental condition, temperature, acceleration, impact, physical parameter, chemical, gas, medical parameter, biological substance and/or agent, radioactivity, or any combination thereof; or transmitted by said transmitter-receiver and provided by said user interface when one of said other sensors detects a dangerous or hazardous environmental condition, temperature, acceleration, impact, physical parameter, chemical, gas, medical parameter, biological substance and/or agent, radioactivity, or any combination thereof, and when a panic button is activated.

30. The protective headgear of claim 18 wherein said imaging device includes a still imager, a video imager, a two dimensional imager and/or a three dimensional imager, and further comprising a further sensor including a radar, a Doppler radar, an ultrasonic sensor, an optical distance measuring sensor, an optical object sensing device, a laser distance measuring sensor, a laser object sensing device, a directional microphone, or a combination thereof, supported on said headgear shell.

31. The protective headgear of claim 30 wherein data from said further sensor:

is stored in said memory, or is coupled to said transmitter-receiver for transmission, or is stored in said memory and is coupled to said transmitter-receiver for transmission.

32. The protective headgear of claim 18 wherein said user interface comprises:

a sound transducer including any one or more of a buzzer, beeper, annunciator, loudspeaker, earphone, an audibly perceptible device, a microphone, a sound pick up device, or any combination thereof; or a visual transducer including any one or more of a light, a flashing light, a light producing different colors, a LED, a LCD display, a visually perceptible device, a display screen, an imaging device to capture still and/or video images, or a combination thereof; or both the sound transducer and the visual transducer.

33. The protective headgear of claim 18 wherein said user interface includes any one or more of an annunciator, loudspeaker, earphone, or an audibly perceptible device, and includes a microphone, or a sound pick up device, coupled to said transmitter-receiver for providing two-way voice communication.

34. The protective headgear of claim 18 wherein the unique identifier stored in said memory or a unique badge identifier stored in a personnel identification badge, or both, are compared with the location data and with personnel location permissions for granting and/or denying access to certain areas and/or equipment to which access is controlled.

35. Protective headgear for use in dangerous and/or hazardous locations comprising:

a headgear shell configured to be worn on a human head;

a locator device supported on said headgear shell for providing location data representative of the location thereof;

a motion sensor supported on said headgear shell for providing motion data representing movement thereof;

an imaging device supported on said headgear shell for providing image data representing a scene proximate said headgear;

a memory supported on said headgear shell and having a unique identifier stored therein, wherein said memory is configured to store the location data provided by said locator device, the motion data provided by said motion sensor, and the image data provided by said imaging device;

an antenna supported on said headgear shell;

a transmitter-receiver coupled to said antenna for transmitting the location data, the motion data, the image data and the unique identifier to a remote database, wherein said transmitter-receiver receives notification data from the remote database which is responsive to the location data and the motion data; and a user interface supported on said headgear shell responsive to the received notification data to provide a visual notification or an audible notification or a physical notification or a combination thereof.

36. The protective headgear of claim 35 wherein said locator device includes:

a global positioning system receiver; or a global positioning system receiver including wide area augmentation.

37. The protective headgear of claim 36 further comprising at least one accelerometer and/or gyroscopic device and/or a received signal strength indication device configured to provide motion data and to provide location data relative to a location determined by said global positioning system receiver, whereby location data is provided when GPS signal to said global positioning system receiver is lost.

38. The protective headgear of claim 35 wherein said motion sensor is configured to provide motion data that is representative of whether a person wearing said protective headgear is animated or is substantially motionless.

39. The protective headgear of claim 38 wherein a notification is transmitted by said transmitter-receiver when the motion data represents that the person wearing said protective headgear is substantially motionless for more than a predetermined period of time.

40. The protective headgear of claim 35 wherein said motion sensor includes at least one accelerometer.

41. The protective headgear of claim 35 in combination with a personnel identification badge comprising:

a memory having a unique badge identifier stored therein; and a transmitter for transmitting the stored unique badge identifier at least to said transmitter-receiver of said protective headgear;

wherein the unique badge identifier is associated with at least the unique identifier of said protective headgear.

42. The protective headgear of claim 41 wherein the transmitter of said personnel identification badge and the transmitter-receiver of said protective headgear communicate wirelessly using an RFID or Bluetooth communication protocol.

43. The protective headgear of claim 35 further comprising a processor, wherein said processor is coupled between said locator device, said motion sensor, said memory and said transmitter-receiver.

44. The protective headgear of claim 35 further comprising one or more other sensors that monitor health-indicating characteristics of personnel, ambient conditions, hazardous substances, hazardous conditions, and/or the environment.

45. The protective headgear of claim 44 wherein said other sensors include sensors of environmental conditions, temperature, pressure, position, acceleration, impact, distance, gyroscopic and/or inertial information, magnetic field, electrical continuity, altitude, a physical parameter, moisture, humidity, chemicals, gases, medical parameters, biological substances and/or agents, radioactivity, optical, light, infrared, images, still and/or video images, sound, noise, electromagnetic fields, and any combination of any two or more thereof.

46. The protective headgear of claim 44 wherein a notification is:

transmitted by said transmitter-receiver when one of said other sensors detects a dangerous or hazardous environmental condition, temperature, acceleration, impact, physical parameter, chemical, gas, medical parameter, biological substance and/or agent, radioactivity, or any combination thereof, and when a panic button is activated; or provided by said user interface when one of said other sensors detects a dangerous or hazardous environmental condition, temperature, acceleration, impact, physical parameter, chemical, gas, medical parameter, biological substance and/or agent, radioactivity, or any combination thereof; or transmitted by said transmitter-receiver and provided by said user interface when one of said other sensors detects a dangerous or hazardous environmental condition, temperature, acceleration, impact, physical parameter, chemical, gas, medical parameter, biological substance and/or agent, radioactivity, or any combination thereof, and when a panic button is activated.

47. The protective headgear of claim 35 wherein said imaging device includes a still imager, a video imager, a two dimensional imager and/or a three dimensional imager, and further comprising a further sensor including a radar, a Doppler radar, an ultrasonic sensor, an optical distance measuring sensor, an optical object sensing device, a laser distance measuring sensor, a laser object sensing device, a directional microphone, or a combination thereof, supported on said headgear shell.

48. The protective headgear of claim 47 wherein data from said further sensor:

is stored in said memory, or is coupled to said transmitter-receiver for transmission, or is stored in said memory and is coupled to said transmitter-receiver for transmission.

49. The protective headgear of claim 35 wherein said user interface comprises:

a sound transducer including any one or more of a buzzer, beeper, annunciator, loudspeaker, earphone, an audibly perceptible device, a microphone, a sound pick up device, or any combination thereof; or a visual transducer including any one or more of a light, a flashing light, a light producing different colors, a LED, a LCD display, a visually perceptible device, a display screen, an imaging device to capture still and/or video images, or a combination thereof; or both the sound transducer and the visual transducer.

50. The protective headgear of claim 35 wherein said user interface includes any one or more of an annunciator, loudspeaker, earphone, or an audibly perceptible device, and includes a microphone, or a sound pick up device, coupled to said transmitter-receiver for providing two-way voice communication.

51. The protective headgear of claim 35 wherein the unique identifier stored in said memory or a unique badge identifier stored in a personnel identification badge, or both, are compared with the location data and with personnel location permissions for granting and/or denying access to certain areas and/or equipment to which access is controlled.

* * * * *